US012312878B2

(12) United States Patent
Kirk et al.

(10) Patent No.: US 12,312,878 B2
(45) Date of Patent: May 27, 2025

(54) CENTRALISER

(71) Applicant: Vulcan Completion Products UK Limited, Aberdeen (GB)

(72) Inventors: Ian Kirk, Aberdeen (GB); Andrew Kirk, Aberdeen (GB); Nathan Kirk, Aberdeen (GB)

(73) Assignee: Vulcan Completion Products UK Limited, Aberdeen (GB)

( * ) Notice: Subject to any disclaimer, the term of this patent is extended or adjusted under 35 U.S.C. 154(b) by 0 days.

(21) Appl. No.: 18/282,928

(22) PCT Filed: Mar. 18, 2022

(86) PCT No.: PCT/GB2022/050696
§ 371 (c)(1),
(2) Date: Sep. 19, 2023

(87) PCT Pub. No.: WO2022/195297
PCT Pub. Date: Sep. 22, 2022

(65) Prior Publication Data

US 2024/0167346 A1 May 23, 2024

(30) Foreign Application Priority Data

Mar. 19, 2021 (GB) ..... 2103896

(51) Int. Cl.
*E21B 17/10* (2006.01)

(52) U.S. Cl.
CPC ..... *E21B 17/1078* (2013.01)

(58) Field of Classification Search
CPC ... E21B 17/10; E21B 17/1021; E21B 17/1078
See application file for complete search history.

(56) References Cited

U.S. PATENT DOCUMENTS 5,261,488 A * 11/1993 Gullet ..... E21B 29/02 166/241.7
2003/0000607 A1* 1/2003 Jenner ..... E21B 17/1028 29/896.9

(Continued)

FOREIGN PATENT DOCUMENTS

WO 2009014865 A1 1/2009
WO 2019202467 A1 10/2019

OTHER PUBLICATIONS

International Search Report and Written Opinion dated May 11, 2022, in connection with PCT/GB2022/050696, filed Mar. 18, 2022.

(Continued)

*Primary Examiner* — Tara Schimpf
*Assistant Examiner* — Ursula Lee Norris
(74) *Attorney, Agent, or Firm* — Downs Rachlin Martin PLLC

(57) ABSTRACT

A centraliser (10) for use in centralising tubing (12) in a bore (W) comprises a first end collar (14), a second end collar (16) and a number of elongate strut members (18). The strut members (18) are interposed between the first end collar (14) and the second end collar (16) and are circumferentially arranged and spaced around the first end collar (14) and second end collar (16). The strut members (18) have angled wing portions (32). The centraliser (10) comprises a retaining arrangement (20) for holding the strut members (18), which comprises a retainer member (22) extending circumferentially between and disposed through the strut members (18). The centraliser (10) comprises a release arrangement (24) configured to release the retaining arrangement (20) and permit the strut members (18) to move between radially retracted and radially extended positions.

20 Claims, 19 Drawing Sheets

(56) References Cited

U.S. PATENT DOCUMENTS

| | | | | |
|---|---|---|---|---|
| 2008/0283253 | A1 | 11/2008 | Buytaert et al. | |
| 2017/0260816 | A1* | 9/2017 | Martin | E21B 17/1014 |
| 2021/0025245 | A1* | 1/2021 | Mackay | E21B 17/1028 |

OTHER PUBLICATIONS

Examination report dated Nov. 26, 2021, in connection with GB2103896.
3, filed Mar. 19, 2021.

* cited by examiner

CENTRALISER

FIELD

This relates to a centraliser for use in centralising tubing in a bore.

BACKGROUND

In the oil and gas exploration and production industry, hydrocarbon bearing formations are accessed by drilling a well borehole ("wellbore") from surface, the wellbore typically then being lined with metal bore-lining tubing known as casing. Sections of casing are typically threaded together to form a casing string which is run into the wellbore, the annulus between the casing string and the wellbore then being filled with a settable material, such as cement, which supports the casing and the wellbore and provides a seal preventing uncontrolled fluid flow up the annulus.

Given that supporting the casing and/or the wellbore and preventing uncontrolled fluid flow up the annulus are critical to ensure the safe operation of a given wellbore, it will be recognised that a poor cementing operation thus poses a significant operational risk for an operator.

One contributory factor to a poor cementing operation is inconsistent thickness of cement in the annulus caused by the casing string deflecting or moving away from the central longitudinal axis of the wellbore. In order to centre the casing string in the wellbore, devices known as centralisers (commonly referred to as "casing centralisers") are typically mounted around the casing string, the centralisers employed to maintain the casing in a generally central position in the wellbore until the sheath of cement surrounding the casing string has set.

Although centralisers are used extensively, there are a number of challenges and drawbacks with conventional tools and equipment.

For example, rigid body centralisers which have fixed radial blades for offsetting the casing string from the wall of the wellbore are not capable of adapting to wellbore restrictions and/or washouts, and thus can inhibit the ability for the casing string to reach the desired total depth in the wellbore.

As an alternative to rigid body centralisers, bow spring centralisers have been developed which have end collars coupled together by elongate spring elements in the form of bow springs. While the spring elements are capable of deflecting radially inwards to permit the casing string to pass through wellbore restrictions, in high angle or horizontal wellbores (referred to generally as horizontal wellbores") the significant weight of the casing string in the horizontal portion of the wellbore can act to deform the spring elements beyond their capacity to maintain the position of the casing string in the desired position such that the casing string lies towards the low side of the wellbore, and thereby risks uneven cementing of the wellbore as described above.

SUMMARY

Aspects of the present disclosure relate to a centraliser for use in centralising tubing in a bore, a downhole assembly and to a method of centralising tubing in a bore.

According to a first aspect, there is provided a centraliser for use in centralising tubing in a bore, comprising:

a first end collar;

a second end collar; and a plurality of strut members interposed between the first end collar and the second end collar, a retaining arrangement for holding the strut members, wherein the retaining arrangement comprises a retainer member extending circumferentially between and disposed through the strut members; and a release arrangement configured to release the retaining arrangement and permit the strut members to move between radially retracted and radially extended positions.

In use, the centraliser may be configured for location on tubing, the centraliser configured to engage the bore to centralise the tubing in the bore as it is run into the bore. The retaining arrangement permits the strut members to be held in compression until released by the release arrangement, at which point the strut members can move between radially retracted and radially extended positions.

Beneficially, the retaining arrangement prevents premature activation of the centraliser, while the release arrangement provides an efficient and effective means to controllably release the retaining arrangement. Moreover, within a downhole system it is common for there to be moving parts which rotate and/or reciprocate within the annulus. These may include, amongst other things, centralisers, rotating noses on float equipment, reamer shoes, perforating guns, liner hangers, packers, external casing and other completion equipment. Since the retainer member is disposed through the strut members, the retainer member is held in position after release; obviating the risk that the retainer member will become an obstruction in the bore. This is significant for a number of reasons. For example, having any obstructions, commonly known as 'junk', loose within the annulus can cause failure due to tangling or bunching up of the loose parts around these moving parts. The annulus is also commonly used to circulate fluids, such as drilling mud and/or cement, which may be critical to the safe and/or efficient operation of the bore. Obstruction of the annulus may require workover and in extreme cases abandonment of the bore, at significant cost to an operator. Loose material is also known to have caused blockage to surface shaker equipment and other surface equipment.

At least one of the strut members may comprise one or more wing portions. The retainer member may be disposed through the wing portions. The wing portions may be angled relative to the strut portion. The one or more wing portions may extend from an underside of the strut member, in particular the intermediate portion of the strut member.

Beneficially, the provision of a centraliser having one or more wing portions which are angled relative to the strut member, in particular relative to an intermediate portion of the strut member, offsets the intermediate portion from the tubing in use. Offsetting the intermediate portion from the tubing may prevent or at least reduce the risk of damage to the strut member which may otherwise occur if the intermediate portion were subject to a force of sufficient magnitude to otherwise deform the strut member to a flat position relative to end collars.

Moreover, providing the retainer member through the wing portions means that the retainer member is disposed in a radially inwards position, having a diameter less than the drift diameter of the centraliser, and thus does not take up any space in the annulus; either before or after release.

Providing the retainer member through the wing portions also means that the retainer member is not only held radially but axially. The position of the retainer member is thus controlled both before and after release.

At least one of the strut members may comprise an aperture for receiving the retainer member therethrough.

The wing portions may comprise the aperture for receiving the retainer member. The aperture may be provided in the one or more wing portions.

The aperture may be provided in an eyelet or a hook that extends from an underside of the strut member, in particular the intermediate portion of the strut member.

Beneficially, providing the retainer member through the aperture in the eyelet or hook means that the retainer member is disposed in a radially inwards position, having a diameter less than the drift diameter of the centraliser, and thus does not take up any space in the annulus; either before or after release.

Providing the retainer member through the aperture in the eyelet or hook also means that the retainer member is not only held radially but axially. The position of the retainer member is thus controlled both before and after release.

The aperture may be circular or substantially circular. The aperture may be elongate, e.g. take the form of a slot. The aperture may comprise or take the form of a closed shaped. The aperture may comprise or take the form of an open shape.

The retaining arrangement may take a number of different forms.

The retaining arrangement may comprise a single retainer member. Alternatively, the retaining arrangement may comprise a plurality of retainer members.

The retainer member may comprise or take the form of a strap. The retainer member may comprise or take the form of a band. The retainer member may comprise or take the form of a wire. The retainer member may comprise or take the form of a rope.

The retainer member may comprise and/or may be at least partially constructed from a metallic material. The retainer member may comprise and/or may be at least partially constructed from steel.

The retainer member may comprise and/or may be at least partially constructed from a composite material. The retainer member may comprise and/or may be at least partially constructed from a carbon fibre composite. The retainer member may comprise and/or may be at least partially constructed from a carbon fibre rope.

The retainer member may comprise and/or may be at least partially constructed from an aramid material. The retainer member may comprise and/or may be at least partially constructed from a para-aramid material. The retainer member may comprise and/or may be at least partially constructed from Kevlar® or like material.

The retainer member may comprise and/or may be at least partially constructed from a polyethylene material. The retainer member may comprise and/or may be at least partially constructed from an ultra-high molecular weight polyethylene material. The retainer member may comprise and/or may be at least partially constructed from Dyneema® or like material.

As described above, the release arrangement is configured to release the retaining arrangement and permit the strut members to move between radially retracted and radially extended positions The release arrangement may comprise a mechanical release arrangement. The mechanical release arrangement may comprise or take the form of a mechanical device configured for activation by one or more of control line, timer, and/or ball actuation. Activation of the mechanical release arrangement may cause the retainer member to release or shear, enabling the centraliser to move from non-deployed position to deployed position. The mechanical release arrangement may comprise a clasp for holding the ends of the retainer member. The mechanical release arrangement may comprise a latch. The clasp may be retained by the latch. The latch may be operable by a control line.

The release arrangement may comprise a magnetic release arrangement. The magnetic release arrangement may comprise or take the form of a magnetic device configured for activation by magnet or electromagnet. Activation of the magnetic release arrangement may cause the retainer member to release or shear, enabling the centraliser to move from non-deployed position to deployed position. The magnetic release arrangement may comprise a clasp for holding the ends of the retainer member. The magnetic release arrangement may comprise a latch. The clasp may be retained by the latch. The magnetic release arrangement may comprise a magnet, e.g. an electro-magnet. The clasp may be retained by the electro-magnet. The electro-magnet may be operable by an electrical cable.

The release arrangement may comprise an electrical release arrangement. The electrical release arrangement may comprise or take the form of an electrical and/or electro-mechanical device configured for activation by one or more of an electrical signal and/or RFID tag or the like. Activation of the electrical release arrangement may cause the retainer member to release or shear, enabling the centraliser to move from non-deployed position to deployed position. The electrical release arrangement may comprise a clasp for holding the ends of the retainer member. The electrical release arrangement may comprise a latch. The clasp may be retained by the latch. The electrical release arrangement may comprise an antenna. The electrical release arrangement may comprise a tag, such as RFID tag. In order to operate the latch, the antenna may communicate with the tag.

The release arrangement may comprise a pressure and/or acoustic pulse release arrangement. The pressure and/or acoustic pulse release arrangement may comprise or take the form of a device configured for activation in response to one or more pressure and/or acoustic pulses. The pressure and/or acoustic pulse release arrangement may utilise pulses in wellbore pressure, fluid flow and/or other fluid. Activation of the pressure pulse and/or acoustic release arrangement may cause the retainer member to release or shear, enabling the centraliser to move from non-deployed position to deployed position. The pressure and/or acoustic pulse release arrangement may comprise a clasp for holding the ends of the retainer member. The pressure and/or acoustic pulse release arrangement may comprise a latch. The pressure and/or acoustic pulse release arrangement may comprise an antenna. In order to operate the latch, the antenna may receive a pressure and/or acoustic pulse signal transmitted from surface or other uphole location.

The release arrangement may comprise a chemical release arrangement. For example, the release arrangement may be configured to dissolve the retainer member. The chemical release arrangement may utilise a dissolvable material such as Magnesium or the like, configured to dissolve at a pre-determined time and/or location. Activation of the chemical release arrangement may cause the retainer member to release or shear, enabling the centraliser to move from non-deployed position to deployed position. The release arrangement may comprise a member. The member may comprise one or more bosses or tabs. For example, the member may comprise two bosses or tabs. The ends of the retainer member may be provided with bores which seat on the bosses or tabs. The member may be constructed, e.g. 3-D printed, from a dissolvable material, e.g. a dissolvable metal. The dissolvable metal may comprise or take the form of magnesium or copper for example. After running the centraliser to the desired position, a dissolving agent may be pumped or otherwise transported downhole. The dissolving agent may be one or more of: water, e.g. fresh water or brine, acid. For example, the drilling fluid may be displaced with fresh water or has a dissolving agent added so that the member dissolves after a selected time, thereby releasing the retainer member. It will be understood that any suitable dissolvable material and dissolving agent may be used.

Each strut member may comprise a first end portion. Each strut member may comprise a second end portion. Each strut member may comprise an intermediate portion interposed between the first end portion and the second end portion. The intermediate portion may have a greater stiffness than the first and second end portions of the strut member.

Beneficially, the provision of a centraliser having one or more strut members with an intermediate portion having a greater stiffness than the end portions of the strut member provides for preferential flexing of the strut member at the end portions rather than the intermediate portion. The preferential flexing of the strut member at the end portions provides a centraliser having sufficient rigidity to maintain the tubing in a generally central position in the bore while also having sufficient flexibility to pass through bore restrictions and recover to the required shape. The provision of wing portions enhances the stiffness of the intermediate portion.

Moreover, the provision of a centraliser having sufficient rigidity to maintain the tubing in a generally central position in the bore while also having sufficient flexibility to pass through bore restrictions and recover to the required shape may permit the number of strut members to be reduced in comparison to a conventional centraliser. This in turn may reduce the force required to run the tubing into the bore, since frictional forces generated by contact with the surrounding bore are reduced.

The ability to maintain the tubing in the generally central position in the bore while also having sufficient flexibility to pass through bore restrictions and recover facilitates an improved cementing operation (or at least mitigates against the possibility of a poor cementing operation) while increasing the ability to reach the required depth in the bore.

As described above, the centraliser may be configured for location on tubing, the centraliser configured to engage the bore to centralise the tubing in the bore.

In particular embodiments, the centraliser may be configured for location on bore-lining tubing, such as casing, and the bore may comprise a wellbore, the centraliser configured to centralise the bore-lining tubing in the wellbore.

However, the centraliser may take other forms. For example, in other instances the centraliser may form, or form part of, a sub forming part of a bore-lining tubing string. In other instances, the centraliser may be configured for location on a tubing string, such as a tool string, work string or the like, configured to be run into bore-lining tubing, the centraliser configured to centralise the tubing string in the bore-lining tubing.

The first end collar and the second end collar may be configured, e.g. sized and/or shaped, to facilitate location of the centraliser on the tubing.

The strut members may be configured, e.g. sized, shaped and/or having sufficient flexibility, to facilitate engagement with the bore.

As described above, the centraliser comprises a first end collar, a second end collar and a plurality of strut members.

In particular embodiments, the centraliser comprises a unitary construction. That is, the first end collar, the second end collar and the strut members may be integrally formed.

Alternatively, the strut members may comprise separate components and the strut members may be coupled to the first end collar and the second end collar. In such embodiments, the centraliser may comprise a coupling arrangement for coupling the strut members to the first end collar and the second end collar. The coupling arrangement may, for example, comprise a clamp and/or weld arrangement for coupling the strut members to the first end collar. The coupling arrangement may, for example, comprise a clamp and/or weld arrangement for coupling the strut member to the second end collar.

The centraliser may be configurable in a first, larger diameter, configuration. In the first configuration, the centraliser may define a larger outer diameter than the outer diameter of the first and second end collars. In the first configuration, the intermediate portion may assume a radially extended position.

The centraliser may be configurable in a second, smaller diameter, configuration. In the second configuration, the centraliser may define a larger outer diameter than the outer diameter of the first and second end collars but a smaller outer diameter than when in the first configuration. In the second configuration, the intermediate portion may assume a radially retracted position relative to the first configuration.

The centraliser may be reconfigurable from the first, larger diameter, configuration to the second, smaller diameter, configuration. The centraliser may be reconfigurable from the second, smaller diameter, configuration to the first, larger diameter, configuration. The strut members may be configured to permit reconfiguration of the centraliser between the first configuration and the second configuration.

In use, the centraliser may be reconfigured from the first configuration to the second configuration on encountering a restriction in the bore to permit the centraliser to traverse the restriction. The centraliser may be reconfigured from the second configuration to the first configuration when the centraliser has passed through the restriction in the bore.

The centraliser may be biased towards the first, larger diameter, configuration. In use, the centraliser may normally define the first configuration but may be reconfigured to the second configuration on encountering a restriction in the bore, the centraliser returning to the first configuration when the restriction has been traversed.

Beneficially, while the centraliser in the second configuration defines a smaller outer diameter than in the first configuration, the strut member in the second configuration are offset from the tubing, thereby preventing or at least reducing the risk of damage to the strut member which may otherwise occur.

As described above, at least one of the strut members may comprise one or more wing portions. The wing portions may extend from the intermediate portion. The wing portions may be angled relative to the intermediate portion. The wing portion may extend inwards, that is generally towards the tubing to be centralised. The wing portion may define any non-zero angle relative to the intermediate portion up to and including 180 degrees. It will be understood that an angle of 180 degrees would mean that the wing portion is folded back towards and runs parallel to the intermediate portion. The wing portion may define a non-zero angle relative to the intermediate portion up to and including 90 degrees or about 90 degrees. In particular embodiments, the wing portion may define an angle of 90 degrees or about 90 degrees relative to the intermediate portion. The wing portion may define a non-zero angle relative to the intermediate portion of or about 10, 20, 30, 40, 50, 60, 70, 80, 100, 110, 120, 130, 140, 150, 160, 170 degrees relative to the intermediate portion.

In particular embodiments, the strut member comprises two wing portions. The wing portions define the same angle with respect to the intermediate portion. However, the wing portions may alternatively define different angles.

The wing portions may be integrally formed with the intermediate portion. For example, the wing portions may be formed by a bend or folded portion of the intermediate portion.

Alternatively, the wing portions may be coupled to the intermediate portion. The wing portions may be coupled to the intermediate portion by any suitable coupling e.g. by a weld connection, an adhesive bond, a mechanical fastener.

At least part of the wing portions may be curved. The wing portions may be curved in a circumferential direction. The wing portions may be curved in an axial direction.

As described above, the centraliser may be reconfigurable to/from the first configuration and the second configuration.

The first and second end portions of the strut members may be configured to permit reconfiguration between the first, larger diameter, configuration and the second, smaller diameter, configuration.

The first and second end portions may be relatively more flexible than the intermediate portion. The first and second end portions may be relatively less stiff than the intermediate portion. The first and second end portions may comprise at least one flexible portion. The end portions may be configured to be at least one of: flexible, bendable, twistable, deformable, or the like. The end portions may be flexible, or configured to be flexible, bendable, twistable, deformable, or the like, in any appropriate way. It will be appreciated that the term "flexing" may refer to bending, twisting, distortion, deformation, and/or any other form of movement of the intermediate portion.

It will be appreciated that at least one feature or component of the centraliser may be curved in one or more than one direction. At least part of the end portions may be curved. The curved section may be defined in any direction in relation to the centraliser. The curved section may be defined in a direction along the member (e.g. the direction may be defined between one end collar to the other end collar or parallel to an axis of the centraliser). The curved section may be defined in a direction across the member (e.g. the direction may be defined circumferentially around an axis of the centraliser, or may be considered perpendicular to the direction defined between the end collars).

The end portions may comprise a non-curved section or curved section defining a second radius of curvature. The non-curved section or curved section defining a second radius of curvature may be defined in a direction across the member. The non-curved section or curved section defining a second radius of curvature may be defined in a direction along the member. The second radius of curvature may be greater than the first radius of curvature. The non-curved section or curved section defining a second radius of curvature may be for permitting movement of the intermediate portion between the radially outer and inner positions.

Providing end portions having a greater radius of curvature than the intermediate portion may provide a degree of flexibility for the end portions that is greater than the flexibility of the (smaller radius of curvature) intermediate portion.

As described above, the end portions may be configured to be less stiff than the intermediate portion. The end portions may each comprise at least two connectors for connecting the respective end portion to the respective end collar. The connectors of each end portion may diverge from the intermediate portion. The connectors may be spaced apart at the end collars. Spacing the connectors of each end portion apart may help to distribute an externally applied load more equally, e.g. circumferentially, around the end collar. If an external load is applied to the intermediate portion, which may in turn be transferred to the first and second end portions, the load may be transferred to the connectors. By spacing the connectors of each end portion apart, the load on each connector may be reduced, which may reduce stress on each connector. Spacing the connectors apart may help to control bending, torsional, or any other forces on the end portions, which may otherwise distort the end portions to such an extent to prohibit or adversely affect recovery of the centraliser to the larger diameter configuration.

The end portions may be bifurcated. The connectors may define a forked or split connector for transferring force between the end portions and the end collars.

The connectors may comprise or define curved edges. As described above, the end portions may be configured to be less stiff than the intermediate portion. The space between the connectors may define an aperture, which may have curved edges. The aperture may define a tear-drop or triangular shape, which may have larger width proximal to the end collar and distal to the intermediate portion. The curved edges of the connectors may help to distribute load more evenly, e.g. to reduce or relieve stress on the connectors. The end portions may comprise a curved section, which may be defined in a direction at least one of: across; and along the member. The curved section may be proximal to the respective end collar and distal to the intermediate portion. The curved section may be for providing the curved section with relatively less flexibility than another part of the end portions.

The end portions may each define a transition portion. The transition portion may be between a curved section of the intermediate portion and a curved section of the respective end collar. The transition portion may comprise a larger radius of curvature than at least one of: the curved section of the intermediate portion; and the curved section of the respective end collar. The transition portion may comprise or define a flat, or relatively less curved, portion of the member, which may be relatively more flexible than at least one of: the intermediate portion and the end collar.

The end collar and/or the intermediate portion may be less flexible than the transition portion. The transition portion may help to spread load or stress along the end portion, or at least soften the transition between the relatively less flexible components, so that load or stress may be less concentrated on the more flexible components. If the end portion comprises a curved section for at least partially resisting flexing, twisting or deformation of the curved section of the end portion, the transition between the end collar (which may be relatively stiff) and the end portion (which may be relatively flexible) may be softened, which may help to spread load or stress along the end portion.

The curved section of end portion may be defined in a direction circumferentially around the centraliser.

The intermediate portion may form or define a paddle of the blade. The intermediate portion may be relatively less flexible than the first and second end portions. The intermediate portion may comprise at least one rigid portion. The intermediate portion may be configured to be resistant to at least one of: flexing, bending, twisting, deforming, or the like. The intermediate portion may be rigid, or configured to be resistant to flexing, bending, twisting, deforming, or the like, in any appropriate way.

At least part of the intermediate portion may be curved. The intermediate portion may comprise a curved section. The curved section may be defined in a direction across the member. The curved section may be defined in a direction along the member. The curved section may define a first radius of curvature, which may correspond to the direction across the member and/or the direction along the member. The curved section may be for providing the intermediate portion with relatively less flexibility than the end portions. The intermediate portion may comprise or define a curved or convex outer surface. The curved or convex outer surface may be defined in a direction along the members or may be defined between the end collars of the centraliser. The end portions may comprise or define a curved or concave outer surface, which may be defined in a direction along the members or may be defined in a direction between the end collars of the centraliser.

The transition portion may comprise the concave outer surface. The intermediate portion may comprise or define a curved or convex outer surface, which may be defined in a direction across the members or may be defined in a direction defined between adjacent members of the centraliser. The intermediate portion may comprise a ridge, rib, protrusion, or the like, which may reduce the contact area between the intermediate portion and the bore wall.

As described above, the centraliser comprises a plurality of strut members at least one of which comprises a first end portion, a second end portion, an intermediate portion and one or more wing portions. While in particular embodiments, the end portions and intermediate portion may define different shaped portions, e.g. with different curved portions, in some instances at least strut member may have end portions and an intermediate portion defining a common overall shape e.g. curvature.

At least one strut member may take the form of a bow spring element.

The strut members may form or define blades of the centraliser.

The strut members may be circumferentially arranged around the first and second end collars. The strut members may be circumferentially spaced around the first and second end collars.

In particular embodiments, the strut members are bifurcated.

The strut members may comprise or define a convex outer surface along a length, for example, an entire length between the end collars. The strut members may comprise at least one of: a convex, flat or concave section along the length of the member. The strut members may comprise or define a convex outer surface along part of the length of the members and may comprise or define at least one of: a flat; and concave outer surface along another part of the length of the member. The direction defined between adjacent members of the centraliser may define a circumferential direction with respect to the centraliser. The end collars may be coaxial with respect to an axis of the centraliser such that the circumferential direction may be defined in relation to the axis of the centraliser.

The end portions may comprise or define at least one of: a curved, convex, concave or flat outer surface in at least one of: a direction defined along; and across the member. The at least one of: the curved, convex, concave or flat outer surface may be defined in a direction defined between adjacent members of the centraliser and/or between the end collars of the centraliser.

In an initial, non-deformed condition or an at least partially-deformed condition, the centraliser may assume the larger diameter configuration, which may define a first radius of curvature. The centraliser may enter the bore in the initial non-deformed condition, and may subsequently be partially deformed to assume the partially-deformed configuration according to the diameter of the bore.

The first radius of curvature may be defined by a radius of the bore. The curved or convex outer surface of the members may define a second radius of curvature, which may be defined in a direction across the members. The second radius of curvature may be equal to or less than the first radius of curvature such as at least in the non-deformed condition or an at least partially-deformed condition of the centraliser. The curved or convex outer surface of the members may comprise a portion, for example a central portion or the like, that is contactable with the bore wall.

The curved or convex outer surface of the members may comprise a portion, for example an edge portion or the like, that is not contactable with the bore wall in the non-deformed or partially deformed configurations.

If the centraliser is deformed, in some circumstances, the edge portions may be in contactable with the bore wall.

Providing edge portions, which may not be contactable with the bore wall, may reduce the friction between the members and the bore wall if moving the centraliser through the bore.

The first radius of curvature may correspond to a radius of curvature of the bore. By providing the second radius of curvature equal to or less than the first radius of curvature, the convex outer surface may have a reduced contact area between the intermediate portion and a bore wall. Reducing the contact area may reduce friction and/or ease passage of the centraliser through the bore.

The centraliser may be configured to assume a different diameter depending on a degree of deformation of the members. The centraliser may comprise at least one support element for restricting flexing or deformation of the members. Restricting flexing or deformation of the members may prevent the centraliser assuming a diameter smaller than a threshold diameter, which may ensure an at least partial recovery of the centraliser to a diameter larger than the threshold diameter.

In an initial condition, the centraliser may describe at least the first diameter, which may correspond to, be larger than, or smaller than the larger diameter configuration.

The centraliser may be reconfigurable to a deformed condition to describe a smaller second diameter to permit passage of the centraliser through a bore restriction.

The centraliser may be reconfigurable to a recovered condition to describe the first diameter and centralise the tubing in the bore.

In the deformed configuration, the degree of deformation of the members may be restricted to ensure recovery of the centraliser to the first diameter.

The second diameter may be equal to or more than the threshold diameter.

The at least one support element may be configurable to abut the tubing upon flexing or deformation of at least one of the members.

The at least one support element may be flexible or deformable.

The at least one support element may be configured to support at least one of: the intermediate portion and the end portions.

The at least one support element may be configured to support a radially outermost part of the members.

The at least one support element may be configured to support a portion of the members comprising a mid-way point between the end collars.

The radially outermost part of the member may define a crest or high point of the members.

The members may each comprise a convex outer surface defined circumferentially around the centraliser.

The outer surface may comprise a contact surface of the members.

The contact surface may be contactable with a wall of the bore.

The convex outer surface may be defined at least partially along a length of the member.

The convex outer surface may be defined at least partially across a width of the member.

The length of the member may be defined as part of the member extending in an axial or downhole direction with respect to the centraliser in the bore.

The width of the member may be defined as part of the member extending in a circumferential direction with respect to the centraliser in the bore.

A thickness of the member may be defined in a radial direction with respect to the centraliser in the bore.

In an initial, non-deformed condition, the centraliser may describe a first diameter that defines a first radius of curvature.

The convex outer surface of the members may each define a second radius of curvature.

The second radius of curvature may be equal to or less than the first radius of curvature.

The first radius of curvature may be defined circumferentially around the bore. The second radius of curvature may be defined circumferentially around the centraliser.

By providing the strut members with the second radius of curvature, there may be reduced friction between the centraliser and the bore when moving the centraliser through the bore. There may be reduced wear of the members due to this reduced friction.

The strut members may comprise at least one end portion for connecting the members to the end collars of the centraliser.

The strut members may comprise at least two end portions for connecting the member to an end collar of the centraliser.

The end portion may be bifurcated.

Providing more than one end portion for each member end may help to evenly distribute force around the end collar.

The strut members may comprise at least two end portions for connecting each end of each member to their respective end collars, wherein the connections between each adjacent end portion on each end collar are equally spaced apart circumferentially around the end collar. It will however be appreciated that in an example, the adjacent connections may not be equally spaced apart circumferentially around the end collar. Depending on the particular geometry of the centraliser, it may or may not be possible to distribute the end portion connections equally spaced apart circumferentially around the end collar. For example, larger diameter centralisers or centralisers comprising more than four, five or six members may provide sufficient space for accommodating equally spaced apart end portion connections while smaller diameter centralisers or centralisers comprising less than four, five or six members may not provide sufficient space for accommodating equally spaced apart end portion connections.

By providing an equal distance as defined between the end portions, there may be an even distribution of force at least partially circumferentially around the end collars of the centraliser. In use, for example in a horizontal section of bore, the centraliser members on the lower side of the bore may experience a greater degree of deformation than those centraliser members on the upper side of the bore. The centraliser members on the lower side of the bore may exert a greater force on the end collars than the force exerted on the end collars by the members on the upper side of the bore.

By providing end portion connections that are equally spaced apart circumferentially around the end collars, the force exerted on the end collars by the members may be more evenly distributed than in the case where the end portion connections are not equally spaced apart circumferentially around the end collars. This may reduce excessive stress or strain being applied to certain parts of the end collars, or indeed within any other part of the centraliser.

The at least one support element may comprise a concave outer surface. The outer surface of the support element may face a wall of the bore. The outer surface of the support element may not, in general, be contactable with the bore wall. The support element may comprise or have an arcuate form.

The support element may comprise a convex inner surface. The convex inner surface may face the casing, and may be moved to abut the casing e.g. in response to being passed through a bore restriction.

The at least one support element may extend from one end portion to another end portion of the members. The at least one support element may be arranged to apply a force between a first end and a second end of the members.

The at least one support element may be configured to apply a force on or resist a force applied by the members. The at least one support element may be configured to provide support at a mid-way point of the members. The mid-way point may be defined between the end collars. The at least one support element may be configured to provide support for the intermediate portion The at least one support element may be centred or symmetric about the mid-way point of the members.

The at least one support element may be configured to apply a force on or resist a force applied by the members. The at least one support element may be configured to provide support at a point along the members that is between a mid-way point and an end portion of the members.

The at least one support element may be positioned along the members so as to be located proximal to one end collar of the centraliser and distal to the other end collar of the centraliser.

The at least one support element may comprise at least one arcuate spring element. At least one support element may extend at least partially along a central portion of at least one of: the intermediate portion and the end portions. At least one support element may extend at least partially along a central portion of the members. At least one support element may extend at least partially along an edge of at least one of: the intermediate portion and the end portions. At least one support element may extend at least partially along an edge of the strut members.

The strut members may comprise or may be formed of a metal.

The centraliser may comprise at least one contact surface for contacting a wall of the bore. The contact surface may comprise a friction-reducing coating. The strut members may comprise the contact surface.

The friction-reducing coating may form part of the strut members. The friction-reducing coating may comprise at least one of: polytetrafluoroethylene; and graphene or like material. Any other appropriate coating may be applied to the strut members to reduce the friction between the strut members and the bore wall, or the strut members may be formed with or modified to comprise the friction-reduction coating. The strut members may comprise a metal.

By providing the strut members with the friction-reducing coating, there may be reduced friction between the centraliser and the wellbore when moving the centraliser through the wellbore. There may be reduced wear of the strut member due to the reduced friction.

The contact surface may comprise a friction-reducing coating forming part of the strut members. The friction-reducing coating may comprise at least one of: polytetrafluoroethylene; and graphene or other suitable friction-reducing coating.

The tubing may comprise bore-lining tubing. The tubing may comprise a bore-lining tubing string. The tubing may comprise casing. The tubing may comprise a casing string. The tubing may comprise a liner. The tubing may comprise a tool string, work string or the like. The tubing may comprise a production screen, or the like.

According to a second aspect, there is provided a method of centralising tubing in a bore using the centraliser of the first aspect.

The method may comprise providing a plurality of centralisers on a string of tubing.

The centralisers may comprise end collars connected by members for permitting the centraliser to assume a different diameter depending on a degree of deformation of the strut members.

The strut members may be restricted to prevent the centraliser assuming a diameter smaller than a threshold diameter.

The method may comprise running the tubing and the centralisers through a bore restriction to radially deform the centralisers.

The method may comprise running the tubing and the centralisers from the bore restriction into a bore section to ensure an at least partial recovery of the centralisers to a diameter larger than the threshold diameter.

The method may have particular utility in running tubing such as casing into inclined or horizontal bores, for example in bores for oil and/or gas wells, where the mass of the tubing will tend to compress or deform the centraliser members located between the tubing and the lower side of the bore. In the absence of restriction of the degree of deformation of the strut members, the strut members between the tubing and the low side of the bore will likely experience a greater degree of deformation than the strut members between the tubing and the high side of the bore and may experience excessive or non-recoverable deformation as the centralisers pass through the bore restriction. On the tubing passing into the bore section beyond the bore restriction, members that have experienced excessive deformation may not recover sufficiently to allow the centraliser to describe the first diameter and maintain the tubing coaxial with the bore.

With the present method the degree of deformation of individual members may be restricted to ensure that the strut members will recover sufficiently to maintain the tubing substantially coaxial with the bore. If the tubing and centralisers are being run through a horizontal tubing restriction there will be a tendency for the centraliser members between the tubing and the low side of the bore to experience a greater degree of deformation, however with the degree of deformation of individual members being restricted, the deformation is more likely to be more evenly distributed between the strut members.

The threshold diameter may define a minimum diameter of the centraliser, below which the strut members may experience excessive deformation to the extent that the excessively deformed members may not recover sufficiently to allow the centraliser to describe a larger target diameter upon moving into the bore section after the bore restriction. By restricting the strut members to prevent the centraliser assuming a diameter smaller than the threshold diameter, the centraliser may be capable of at least partially recovering to a larger diameter than the threshold diameter so as maintain the tubing substantially coaxial with the bore.

Those of skill in the art will recognise that with a deformable centraliser there will always be an inevitable degree of deformation of the strut members on the low side of the tubing in inclined or horizontal bores applications, and this is recognised by, for example, the American Petroleum Institute's Specification 10D for spring bow centralisers.

The centralisers may describe at least a first diameter in an initial condition. The method may comprise radially deforming the centralisers to describe a smaller second diameter defined by the bore restriction.

The centraliser may be in the initial condition before entering the bore.

The diameter of the bore may define the first diameter.

Upon entering the bore, the centralisers may be partially deformed to assume the first diameter.

The second diameter may be equal to or more than the threshold diameter. Upon being deformed in the bore restriction, the centralisers may not be deformed to a diameter less than the threshold diameter.

By only deforming the centralisers to a diameter equal to or more than the threshold diameter, the centralisers may not experience excessive deformation.

Restricting the strut members to prevent the centraliser assuming a diameter smaller than a threshold diameter may comprise providing at least one support element between the strut members and the tubing.

The at least one support element may be arranged to prevent deformation of the strut members resulting in the centraliser describing a diameter below the threshold diameter.

The method may comprise restricting deformation of the strut members by abutting the at least one support element against the tubing in response to a radial compression of at least one of the strut members.

The method may comprise moving the centralisers through a bore restriction in an inclined or horizontal bore section.

The method may comprise restricting members on a lower side of the centraliser from deforming excessively in response to a weight applied on the strut members by the tubing as the centraliser passes through the bore restriction.

Restricting members on the lower side of the centraliser from deforming may comprise supporting the tubing so that the tubing adopts a substantially coaxial position within at least one of: the bore restriction and the bore section.

Supporting the tubing may comprise providing at least one support element for maintaining the tubing in the substantially coaxial position. The at least one support element may resist deformation of the members on the lower side of the bore so as to maintain the tubing at a minimum radial distance above the lower sider of the bore. The minimum radial distance may be defined by the threshold diameter. The minimum radial distance may be defined by the diameter of the bore restriction. The minimum radial distance may be equal or approximately equal to half of the difference between the threshold or bore restriction diameter and the diameter of the tubing.

According to a third aspect, there is provided a downhole assembly comprising at least one centraliser of the first aspect.

The assembly may comprise a plurality of the centralisers according to the first aspect.

The assembly may comprise tubing.

The invention is defined by the appended claims. However, for the purposes of the present disclosure it will be understood that any of the features defined above or described below may be utilised in isolation or in combination. For example, features described above in relation to one of the above aspects or below in relation to the detailed description below may be utilised in any other aspect, or together form a new aspect.

DETAILED DESCRIPTION OF THE DRAWINGS

Figure 1:
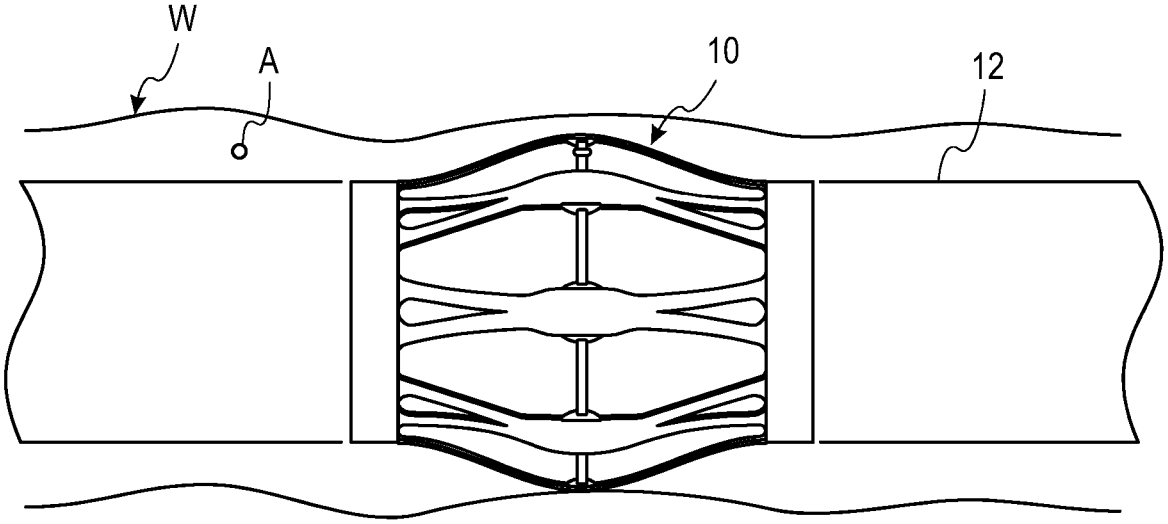
FIG. 1 shows a centraliser for centralising tubing in a wellbore.

Referring first to FIGS. 1 to 13 of the accompanying drawings, there is shown a centraliser 10 for use in centralising tubing 12 in a bore W. As shown in FIG. 1, which shows a diagrammatic view of the centraliser 10 in the bore W, the tubing 12 takes the form of a casing string and the bore W takes the form of a wellbore, the annulus A between the tubing 12 and the bore W then being filled with a settable material, such as cement, which supports the tubing 12 and the bore W and provides a seal preventing uncontrolled fluid flow up the annulus A.

In use, and will be described further below, the centraliser 10 is configured to engage the wall of the wellbore W to centralise the tubing 12 in the bore W.

As shown, the centraliser 10 comprises a unitary construction having a first end collar 14, a second end collar 16 and a number of elongate strut members 18. The first and second end collars 14, 16 are generally cylindrical in shape and are configured to mount the centraliser 10 onto the tubing 12. The strut members 18 are interposed between the first end collar 14 and the second end collar 16 and are circumferentially arranged and spaced around the first end collar 14 and second end collar 16. In the illustrated centraliser 10, the centraliser 10 has eight strut members 18. However, it will be recognised that the centraliser 10 may have any suitable number of strut members 18. The strut members 18 form blades of the centraliser 10.

The centraliser 10 further comprises a retaining arrangement, generally denoted 20, for holding the strut members 18. The retaining arrangement 20 comprises a retainer member 22 which extends circumferentially between and disposed through the strut members 18.

In the illustrated centraliser 10, the retainer member 22 takes the form of a band of steel. However, it will be understood that the retainer member 22 may take a variety of different forms and be constructed from a variety of materials.

Figure 9:
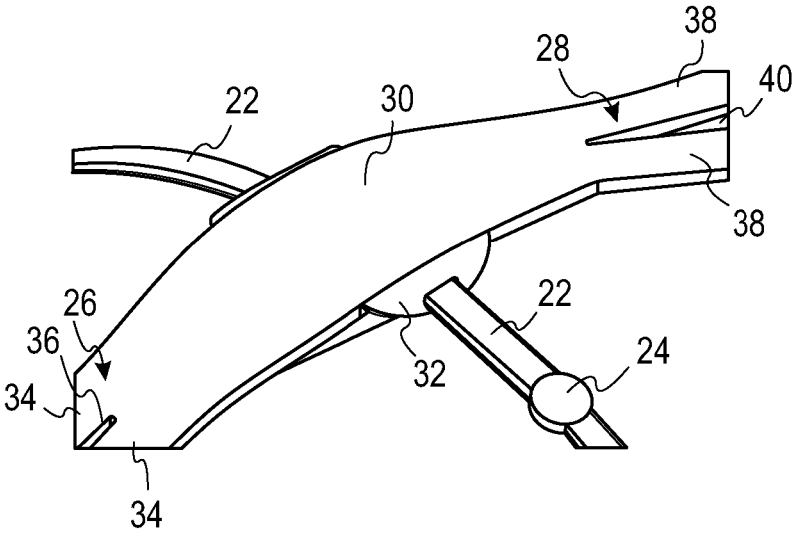
FIGS. 9, 10 and 11 show enlarged views of parts of the centraliser shown in FIG. 1.
Figure 10:
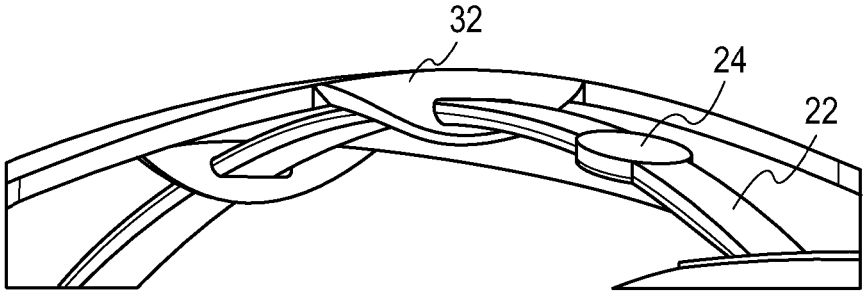
Figure 11:
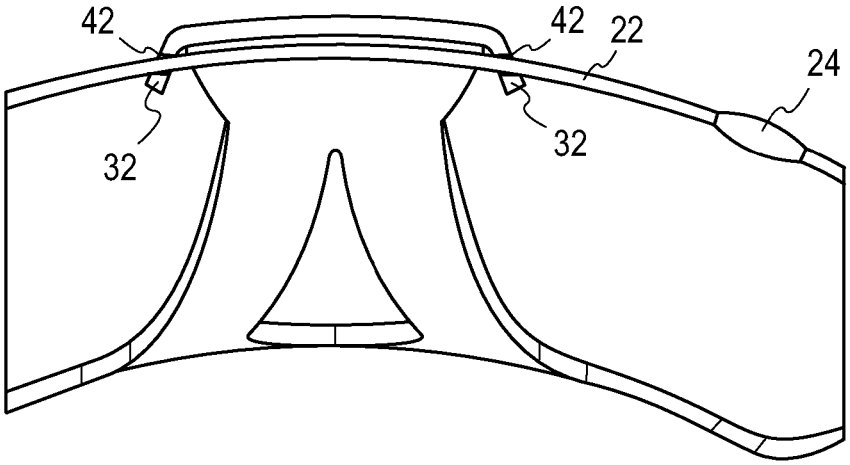

As shown most clearly in FIGS. 9 and 10 of the accompanying drawings, the centraliser 10 further comprises a release arrangement 24. The release arrangement 24 is configured to release the retaining arrangement 20 and permit the strut members 18 to move between radially retracted and radially extended positions.

In use, the retaining arrangement 20 permits the strut members 18 to be held in compression until released by the release arrangement 24, at which point the strut members 18 can move between radially retracted and radially extended positions.

Beneficially, the retaining arrangement 20 prevents premature activation of the centraliser 10 while the release arrangement 24 provides an efficient and effective means to controllably release the retaining arrangement 20. Moreover, within a downhole system it is common for there to be moving parts which rotate and/or reciprocate within the annulus. These may include, amongst other things, centralisers, rotating noses on float equipment, reamer shoes, perforating guns, liner hangers, packers, external casing and other completion equipment. Since the retainer member 22 is disposed through the strut members 18, the retainer member 22 is held in position after release; obviating the risk that the retainer member 22 will become an obstruction in the bore W. This is significant for a number of reasons. For example, having any obstructions, commonly known as 'junk', loose within the annulus A can cause failure due to tangling or bunching up of the loose parts around these moving parts. The annulus A is also commonly used to circulate fluids, such as drilling mud and/or cement, which may be critical to the safe and/or efficient operation of the bore W. Obstruction of the annulus A may require workover and in extreme cases abandonment of the bore W, at significant cost to an operator. Loose material is also known to have caused blockage to surface shaker equipment and other surface equipment.

Figure 2:
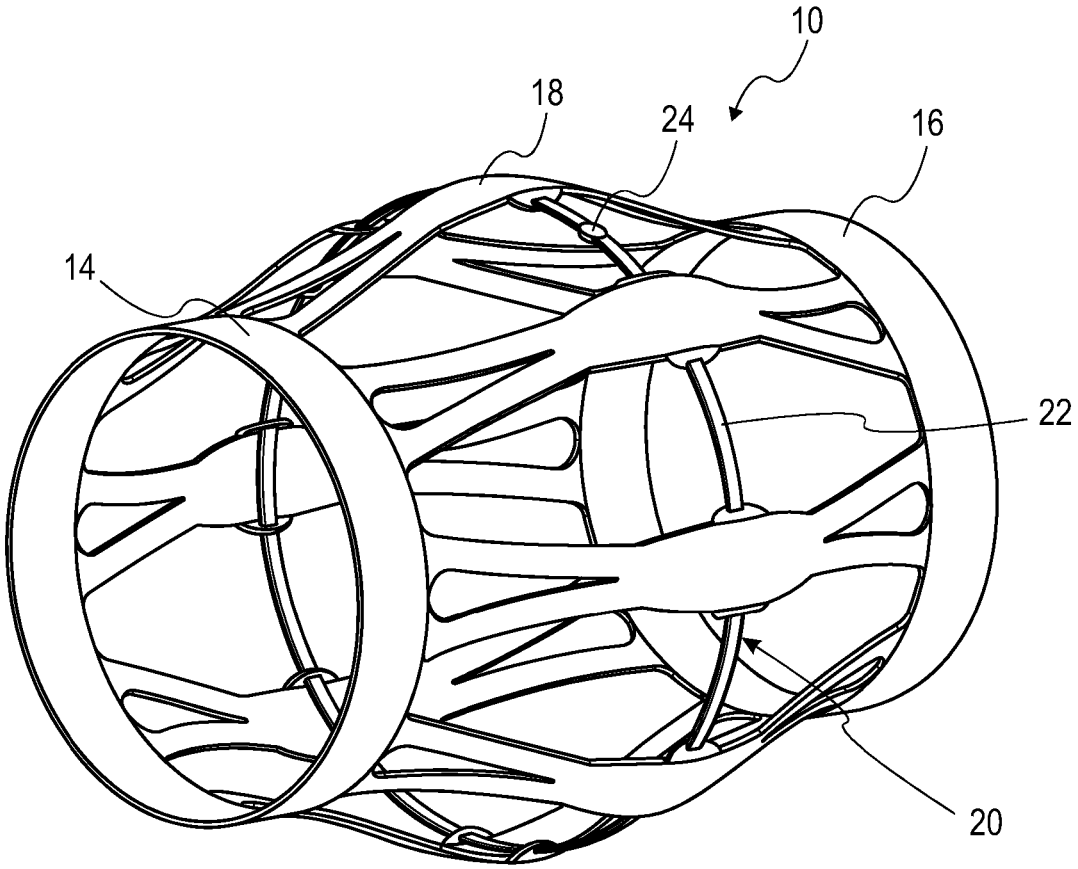
FIG. 2 shows a perspective view of the centraliser shown in FIG. 1.
Figure 3:
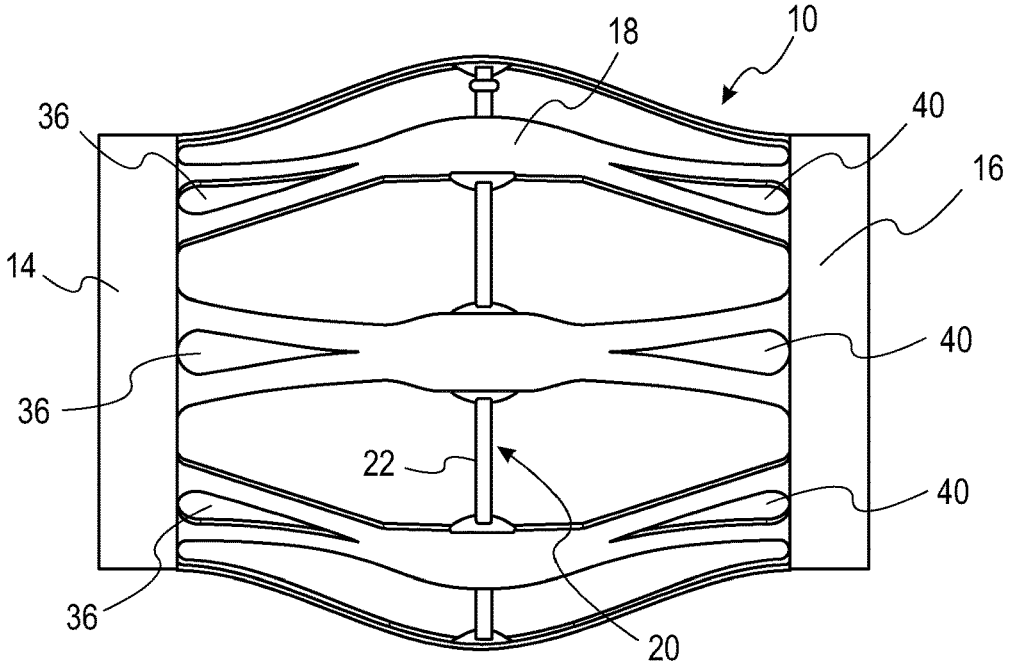
FIG. 3 shows a side view of the centraliser shown in FIG. 1.
Figure 4:
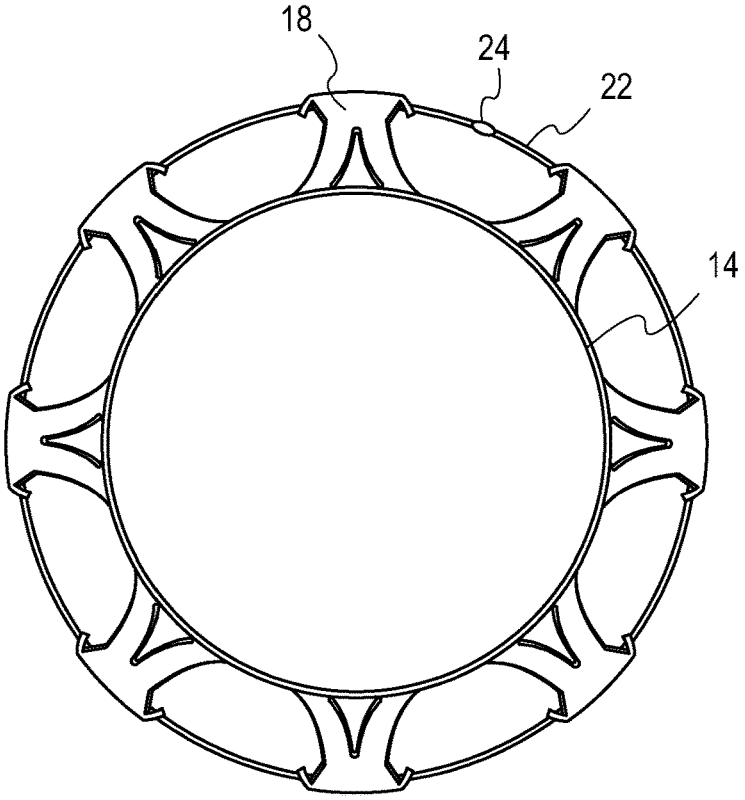
FIG. 4 shows an end view of the centraliser shown in FIG. 1.
Figure 5:
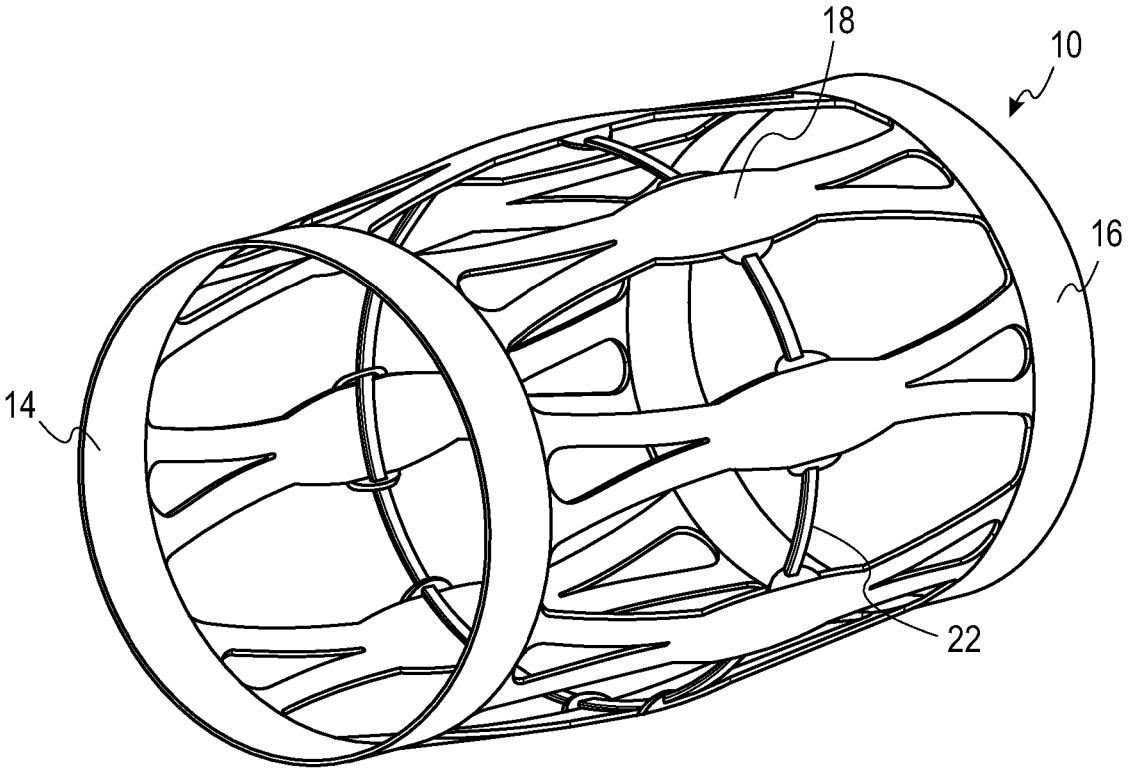
FIG. 5 shows a perspective view of the centraliser shown in FIG. 1, in a radially retracted position.
Figure 6:
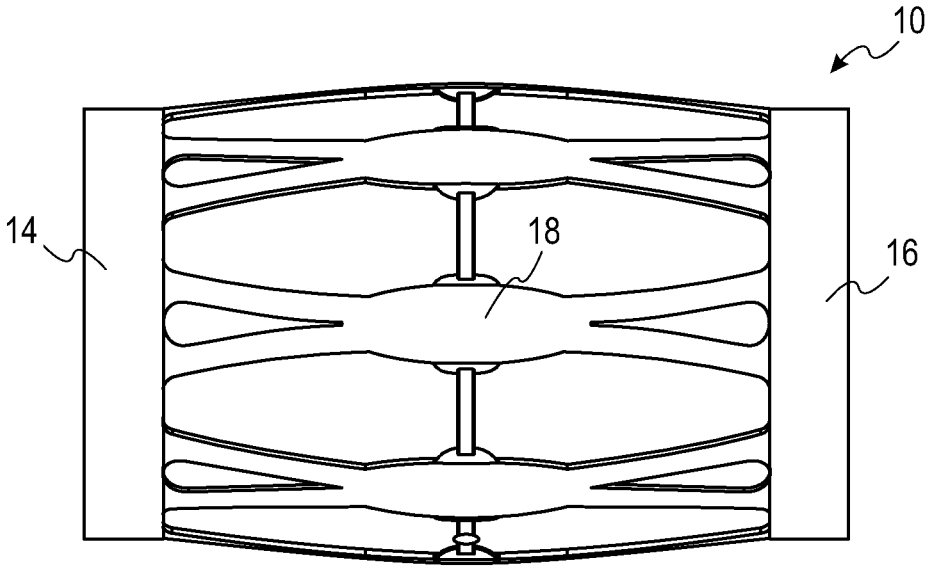
FIG. 6 shows a side view of the centraliser shown in FIG. 5, in the radially retracted position.
Figure 7:
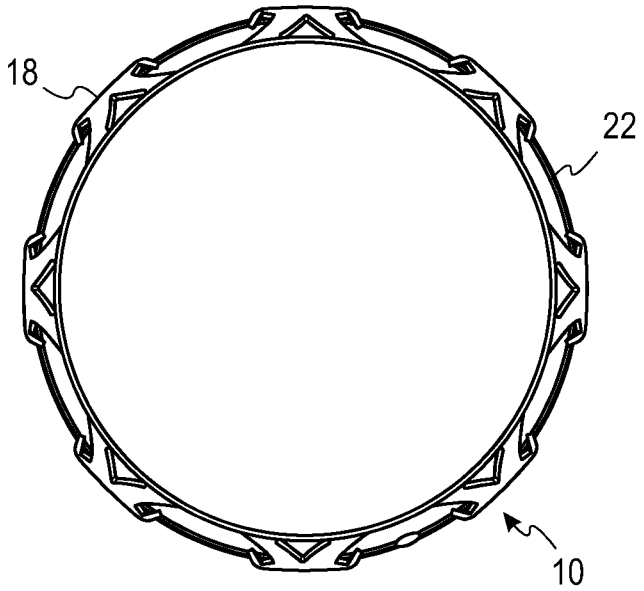
FIG. 7 shows an end view of the centraliser shown in FIG. 5, in the radially retracted position.
Figure 8:
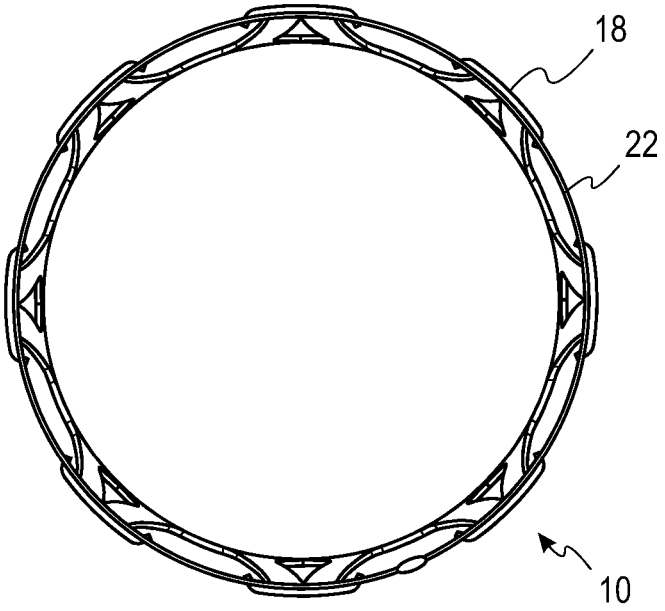
FIG. 8 shows a cross-sectional view of the centraliser shown in FIG. 5, in the radially retracted position.

As shown for example in FIGS. 2 and 9 of the accompanying drawings, each of the strut members 18 has a first end portion 26, a second end portion 28, an intermediate portion 30 and wing portions 32.

In the illustrated centraliser 10, the first end portion 26 of the strut member 18 is bifurcated, having two connector portions 34 for connecting the first end portion 26 to the first end collar 14. An aperture 36, which in the illustrated centraliser 10 takes the form of a teardrop-shaped aperture, is defined between the connector portions 28 and the first end collar 14. The second end portion 28 of the strut member 18 is also bifurcated, having two connector portions 38 for connecting the second end portion 28 to the second end collar 16. An aperture 40, which in the illustrated centraliser 10 also takes the form of a teardrop-shaped aperture, is defined between the connector portions 38 and the second end collar 16. In the illustrated centraliser 10, the connector portions 34, 38 diverge from the intermediate portion 30 so as to be spaced apart at the first and second end collars 14, 16.

As shown, the intermediate portion 30 is curved in both circumferential and axial directions and defines a convex curved outer surface. The curved shaped of the intermediate portion 30 provides for greater stiffness than the end portions 26, 28.

The wing portions 32 extend from the intermediate portion 30 and are angled relative to the intermediate portion 30. In the illustrated centraliser 10, the wing portions 32 define an angle of approximately 90 degrees to the intermediate portion 30. However, the wing portions 32 may define other angles with respect to the intermediate portion 30.

As shown in FIG. 10 of the accompanying drawings, for example, the wing portions 32 are also curved in an axial direction.

The wing portions 32 have been found to further enhance the stiffness of the intermediate portion 30 relative to the end portions 26,28. Moreover, the provision of wing portions 32 which are angled relative to the intermediate portion 30 offsets the intermediate portion 30 from the tubing 12 in use.

Beneficially, the provision of a centraliser 10 having one or more strut members 18 with an intermediate portion 30 having a greater stiffness than the end portions 26, 28 of the strut member 18 provides for preferential flexing of the strut member 18 at the end portions 26,28 rather than the intermediate portion 30. The preferential flexing of the strut members 18 at the intermediate portion 30 provides a centraliser 10 having sufficient rigidity to maintain the tubing 12 in a generally central position in the bore W while also having sufficient flexibility to pass through wellbore restrictions and/or washouts and recover to the required shape. The provision of wing portions 32 has been found to further enhance the stiffness of the intermediate portion 30 relative to the end portions 26,28. Moreover, the provision of the wing portions 32 which are angled relative to the intermediate portion 30 offsets the intermediate portion 30 from the tubing 12 in use.

Figure 12:
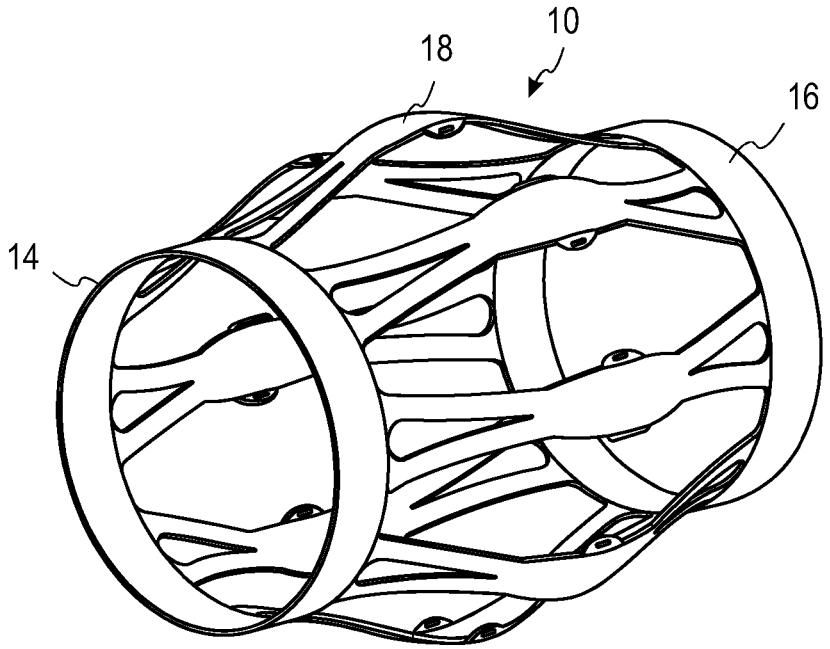
FIG. 12 shows a perspective view of the centraliser shown in FIG. 1, with retainer member removed.
Figure 13:
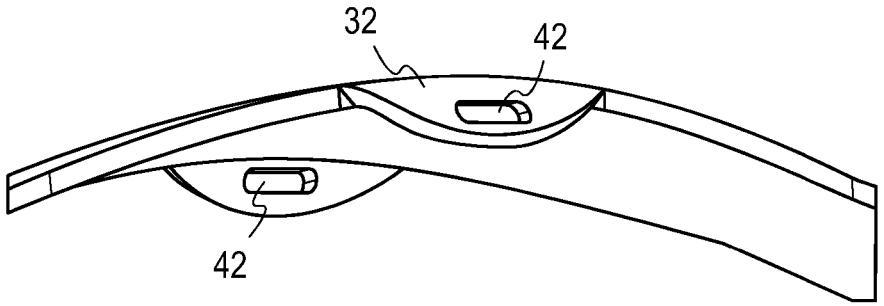
FIG. 13 shows an enlarged view of part of the centraliser shown in FIG. 1, with retainer member removed.

As shown most clearly in FIGS. 12 and 13, which show the centraliser 10 with the retainer member 22 removed, each of the wing portions 32 has an aperture 42 through which the retainer member 22 is disposed. In the illustrated centraliser 10, the apertures 42 take the form of elongate slots.

Providing the retainer member 22 through the wing portions 32 means that the retainer member 22 is disposed in a radially inwards position, having a diameter less than the drift diameter of the centraliser 10, and thus does not take up any space in the annulus A; either before or after release.

Moreover, providing the retainer member 22 through the wing portions 32 also means that the retainer member 22 is not only held radially but axially. The position of the retainer member 22 is thus further controlled both before and after release.

It will be recognised that various modifications may be made without departing from the scope of the invention as defined in the claims.

For example, FIGS. 14 to 22 of the accompanying drawings show an alternative centraliser 110 for centralising the tubing 12 in the bore W.

Figure 14:
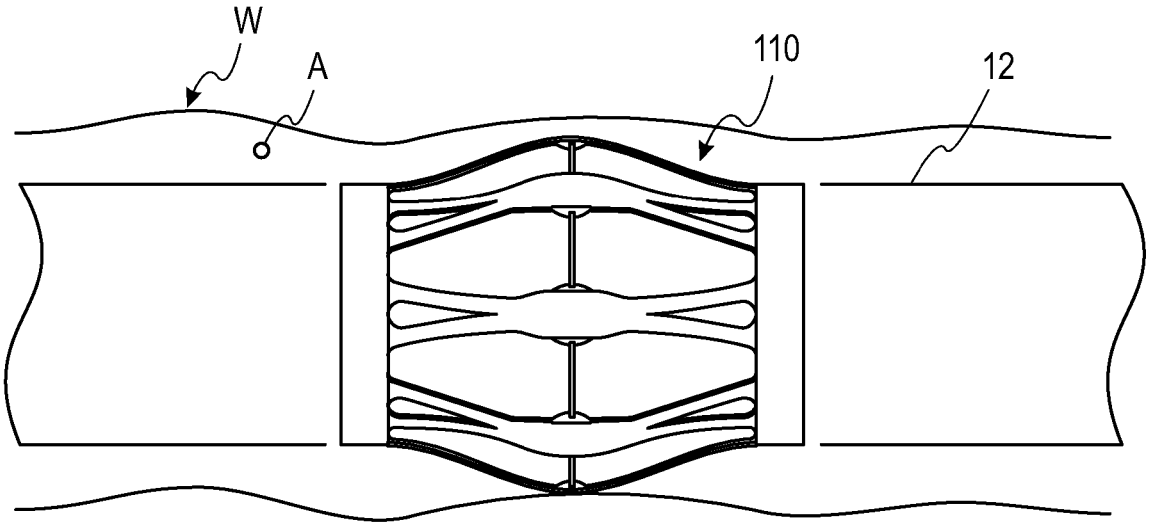
FIG. 14 shows an alternative centraliser for centralising tubing in a wellbore.
Figure 15:
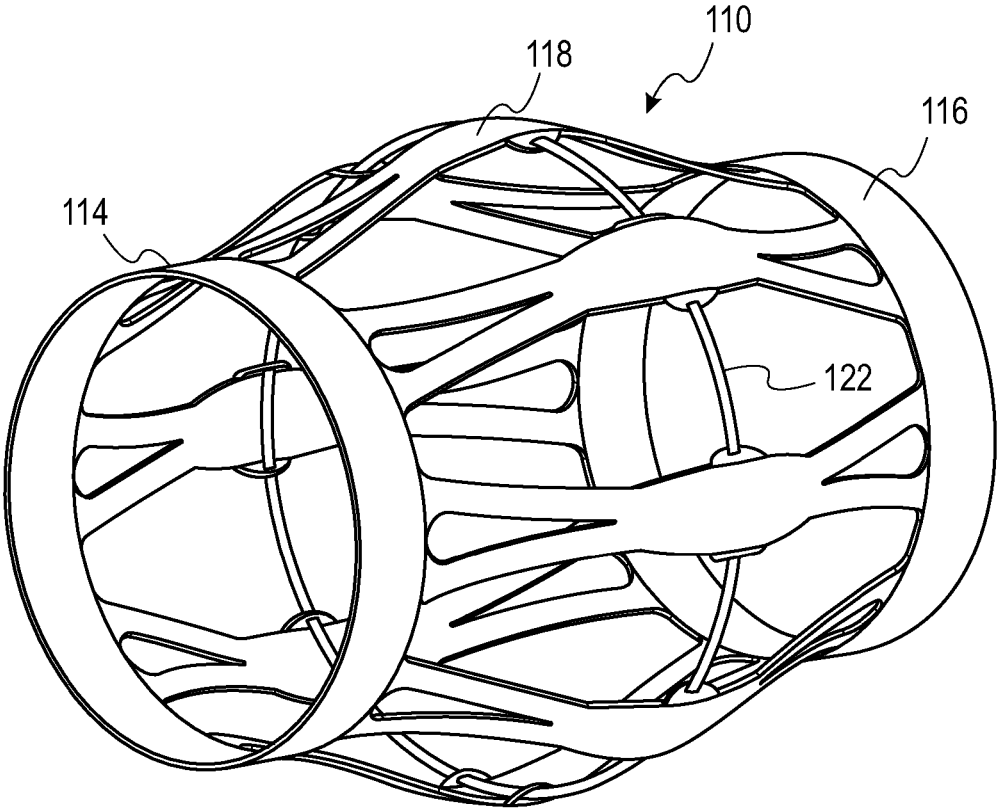
FIG. 15 shows a perspective view of the centraliser shown in FIG. 14.
Figure 16:
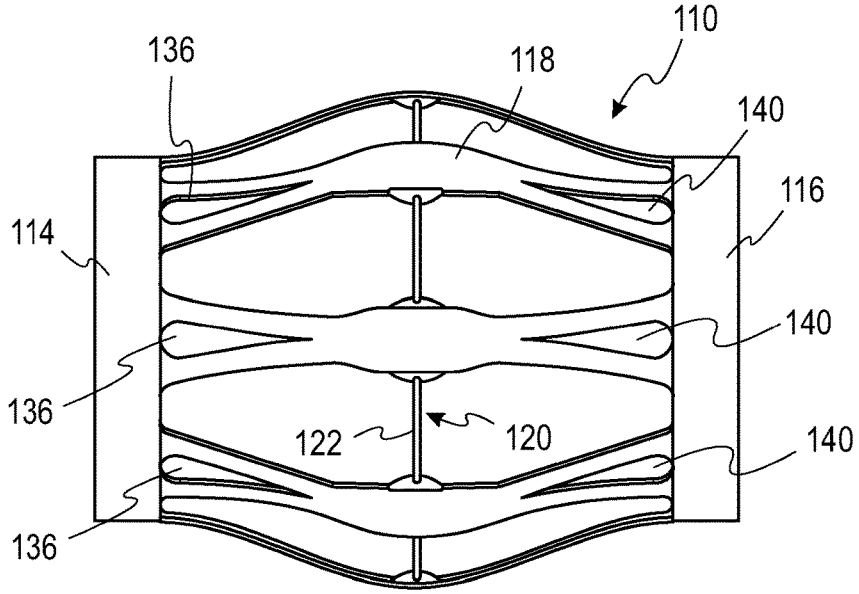
FIG. 16 shows a side view of the centraliser shown in FIG. 14.

As shown in FIG. 14, which shows a diagrammatic view of the centraliser 110 in the bore W, the tubing 12 takes the form of a casing string and the bore W takes the form of a wellbore, the annulus A between the tubing 12 and the bore W then being filled with a settable material, such as cement, which supports the tubing 12 and the bore W and provides a seal preventing uncontrolled fluid flow up the annulus A.

In use, and will be described further below, the centraliser 110 is configured to engage the wall of the wellbore W to centralise the tubing 12 in the bore W.

As shown, the centraliser 110 comprises a unitary construction having a first end collar 114, a second end collar 116 and a number of elongate strut members 118. The first and second end collars 114,116 are generally cylindrical in shape and are configured to mount the centraliser 110 onto the tubing 12. The strut members 118 are interposed between the first end collar 114 and the second end collar 116 and are circumferentially arranged and spaced around the first end collar 114 and second end collar 116. In the illustrated centraliser 110, the centraliser 110 has eight strut members 118. However, it will be recognised that the centraliser 110 may have any suitable number of strut members 118. The strut members 118 form blades of the centraliser 110.

The centraliser 110 further comprises a retaining arrangement, generally denoted 120, for holding the strut members 118. The retaining arrangement 120 comprises a retainer member 122 which extends circumferentially between and disposed through the strut members 118.

In the illustrated centraliser 110, the retainer member 122 takes the form of a carbon rope. However, it will be understood that the retainer member 122 may take a variety of different forms and be constructed from a variety of materials.

Figure 17:
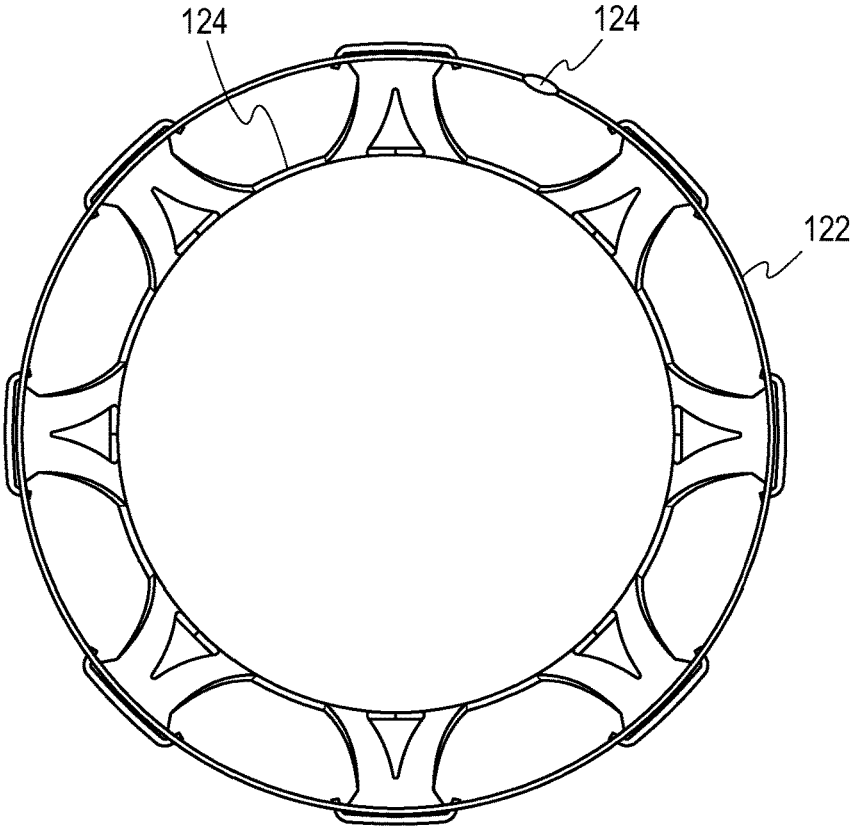
FIG. 17 shows an end view of the centraliser shown in FIG. 14.

As shown most clearly in FIG. 17 of the accompanying drawings, the centraliser 110 further comprises a release arrangement 124. The release arrangement 124 is configured to release the retaining arrangement 120 and permit the strut members 118 to move between radially retracted and radially extended positions.

In use, the retaining arrangement 120 permits the strut members 118 to be held in compression until released by the release arrangement 124, at which point the strut members 118 can move between radially retracted and radially extended positions.

Beneficially, the retaining arrangement 120 prevents premature activation of the centraliser 110 while the release arrangement 124 provides an efficient and effective means to controllably release the retaining arrangement 120. Moreover, within a downhole system it is common for there to be moving parts which rotate and/or reciprocate within the annulus. These may include, amongst other things, centralisers, rotating noses on float equipment, reamer shoes, perforating guns, liner hangers, packers, external casing and other completion equipment. Since the retainer member 122 is disposed through the strut members 118, the retainer member 122 is held in position after release; obviating the risk that the retainer member 122 will become an obstruction in the bore W. This is significant for a number of reasons. For example, having any obstructions, commonly known as 'junk', loose within the annulus A can cause failure due to tangling or bunching up of the loose parts around these moving parts. The annulus A is also commonly used to circulate fluids, such as drilling mud and/or cement, which may be critical to the safe and/or efficient operation of the bore W. Obstruction of the annulus A may require workover and in extreme cases abandonment of the bore W, at significant cost to an operator. Loose material is also known to have caused blockage to surface shaker equipment and other surface equipment.

Figure 18:
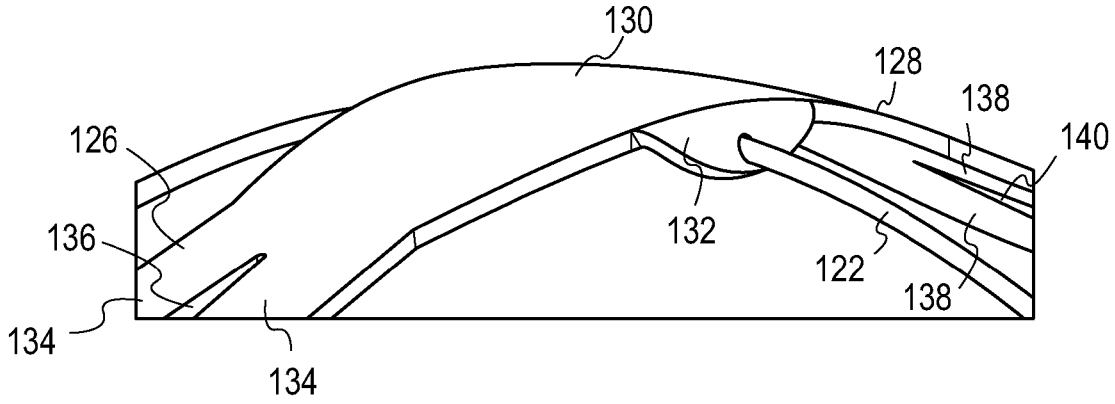
FIGS. 18, 19 and 20 show enlarged views of parts of the centraliser shown in FIG. 14.
Figure 19:
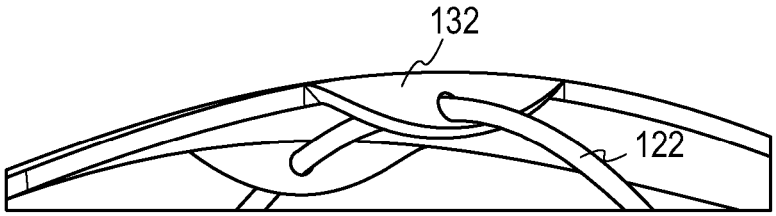
Figure 20:
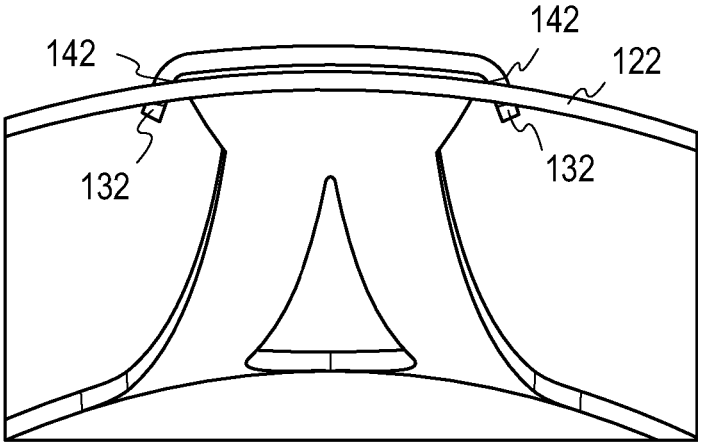

As shown for example in FIG. 18 of the accompanying drawings, each of the strut members 118 has a first end portion 126, a second end portion 128, an intermediate portion 130 and wing portions 132.

In the illustrated centraliser 110, the first end portion 126 of the strut member 118 is bifurcated, having two connector portions 134 for connecting the first end portion 120 to the first end collar 114. An aperture 136, which in the illustrated centraliser 110 takes the form of a teardrop-shaped aperture, is defined between the connector portions 128 and the first end collar 114. The second end portion 128 of the strut member 118 is also bifurcated, having two connector portions 138 for connecting the second end portion 128 to the second end collar 116. An aperture 140, which in the illustrated centraliser 110 also takes the form of a teardrop-shaped aperture, is defined between the connector portions 132 and the second end collar 116. In the illustrated centraliser 110, the connector portions 134, 138 diverge from the intermediate portion 130 so as to be spaced apart at the first and second end collars 114,116.

As shown, the intermediate portion 130 is curved in both circumferential and axial directions and defines a convex curved outer surface. The curved shaped of the intermediate portion 130 provides for greater stiffness than the end portions 126,128.

The wing portions 132 extend from the intermediate portion 130 and are angled relative to the intermediate portion 130. In the illustrated centraliser 10, the wing portions 132 define an angle of approximately 90 degrees to the intermediate portion 130. However, the wing portions 132 may define other angles with respect to the intermediate portion 130.

As shown in FIG. 18, for example, the wing portions 132 are also curved in an axial direction.

The wing portions 132 have been found to further enhance the stiffness of the intermediate portion 130 relative to the end portions 126,128. Moreover, the provision of the wing portions 132 which are angled relative to the intermediate portion 130 offsets the intermediate portion 130 from the tubing 12 in use.

Beneficially, the provision of a centraliser 110 having one or more strut members 118 with an intermediate portion 130 having a greater stiffness than the end portions 126,128 of the strut member 118 provides for preferential flexing of the strut member 118 at the end portions 126,128 rather than the intermediate portion 130. The preferential flexing of the strut members 118 at the intermediate portion 130 provides a centraliser 110 having sufficient rigidity to maintain the tubing 12 in a generally central position in the bore W while also having sufficient flexibility to pass through wellbore restrictions and recover to the required shape. The provision of wing portions 132 has been found to further enhance the stiffness of the intermediate portion 130 relative to the end portions 126,128. Moreover, the provision of the wing portions 132 which are angled relative to the intermediate portion 130 offsets the intermediate portion 124 from the tubing 12 in use.

Figure 21:
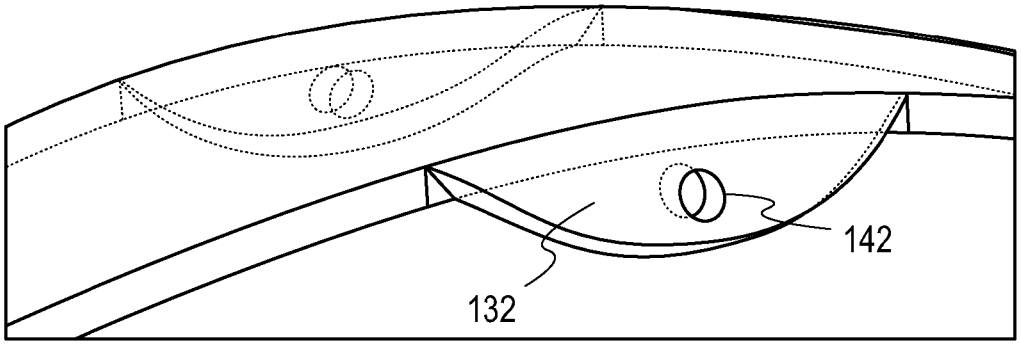
FIGS. 21 and 22 show enlarged view of parts of the centraliser shown in FIG. 14, with retainer member removed.
Figure 22:
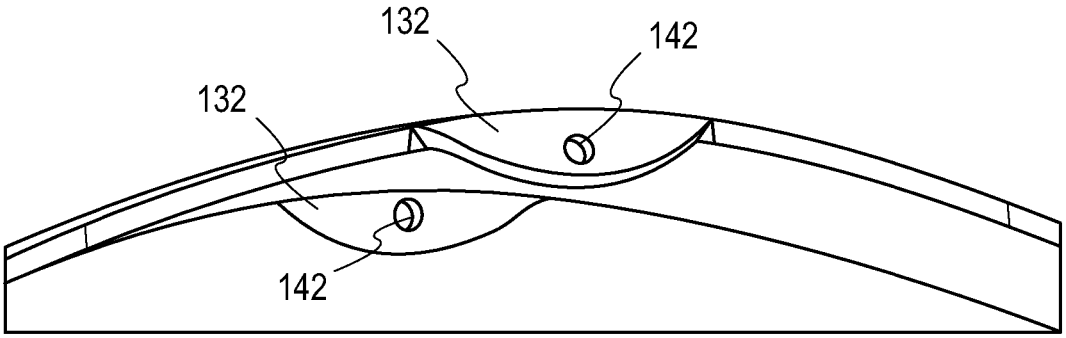

As shown most clearly in FIGS. 21 and 22, which show the centraliser 110 with the retainer member 122 removed, each of the wing portions 132 has an aperture 142 through which the retainer member 122 is disposed. In the illustrated centraliser 110, the apertures 142 are circular.

Providing the retainer member 122 through the wing portions 132 means that the retainer member 122 is disposed in a radially inwards position, having a diameter less than the drift diameter of the centraliser 110, and thus does not take up any space in the annulus A; either before or after release.

Moreover, providing the retainer member 122 through the wing portions 132 also means that the retainer member 122 is not only held radially but axially. The position of the retainer member 122 is thus further controlled both before and after release.

As noted above, it will be recognised that various modifications may be made without departing from the scope of the invention as defined in the claims.

For example, FIGS. 23 to 31 of the accompanying drawings shows an alternative centraliser 210 for centralising the tubing 12 in the bore W.

Figure 23:
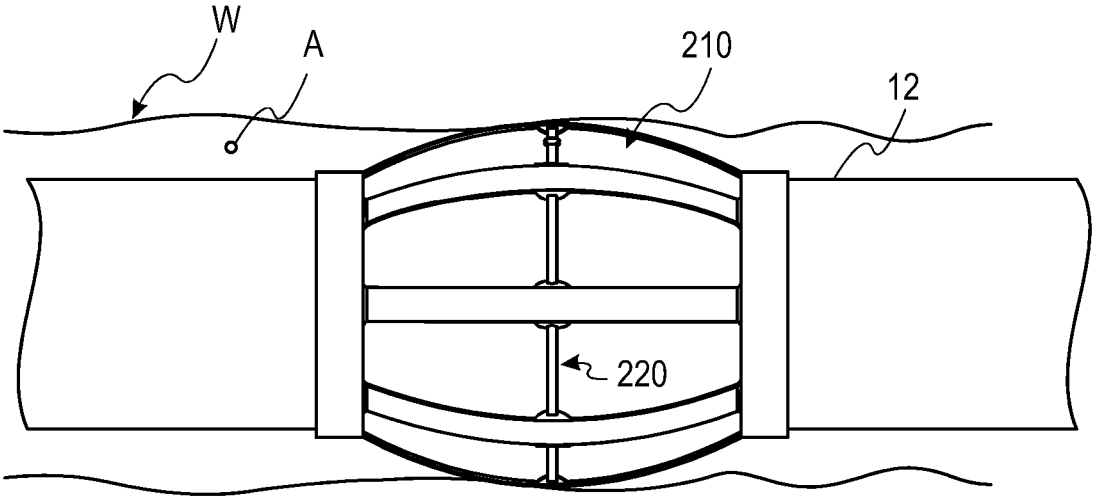
FIG. 23 shows an alternative centraliser for centralising tubing in a wellbore.
Figure 24:
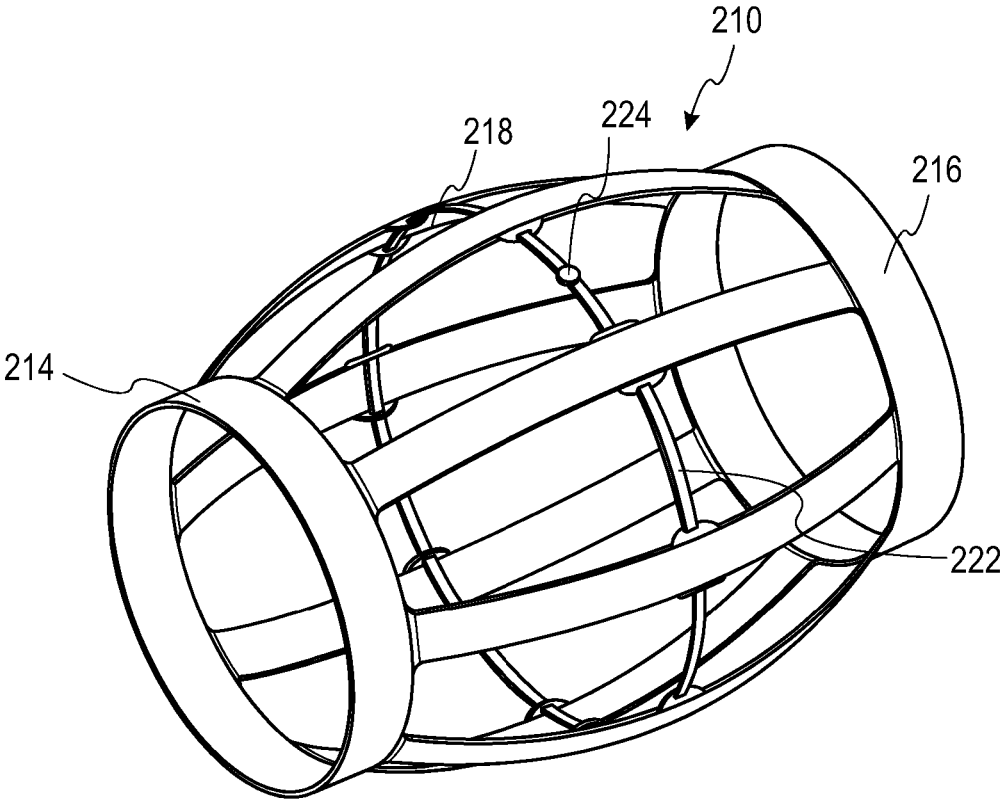
FIG. 24 shows a perspective view of the centraliser shown in FIG. 23.
Figure 25:
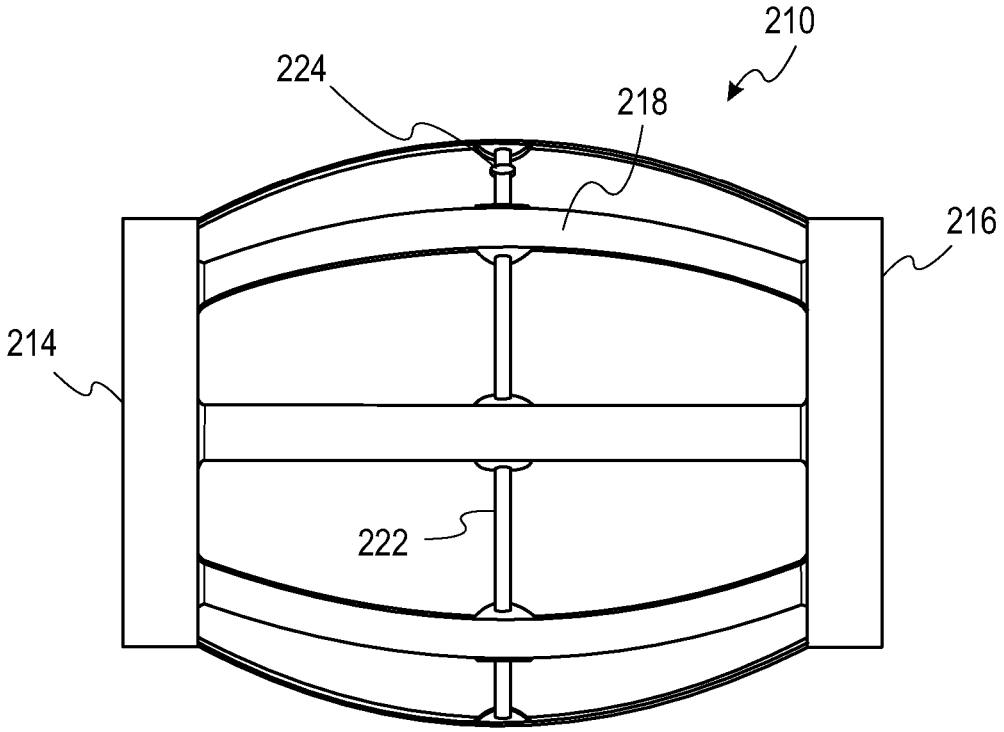
FIG. 25 shows a side view of the centraliser shown in FIG. 23.
Figure 26:
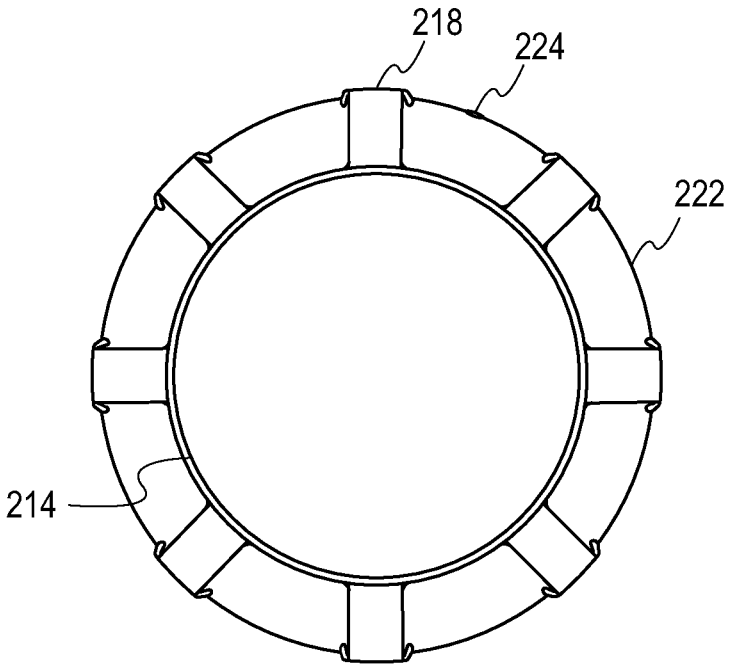
FIG. 26 shows an end view of the centraliser shown in FIG. 23.

As shown in FIG. 23, which shows a diagrammatic view of the centraliser 210 in the bore W, the tubing 12 takes the form of a casing string and the bore W takes the form of a wellbore, the annulus A between the tubing 12 and the bore W then being filled with a settable material, such as cement, which supports the tubing 12 and the bore W and provides a seal preventing uncontrolled fluid flow up the annulus A.

In use, and will be described further below, the centraliser 210 is configured to engage the wall of the wellbore W to centralise the tubing 12 in the bore W.

As shown, the centraliser 210 comprises a unitary construction having a first end collar 214, a second end collar 216 and a number of elongate strut members 218. The first and second end collars 214,216 are generally cylindrical in shape and are configured to mount the centraliser 210 onto the tubing 12. The strut members 218 are interposed between the first end collar 214 and the second end collar 216 and are circumferentially arranged and spaced around the first end collar 214 and second end collar 216. In the illustrated centraliser 210, the centraliser 210 has eight strut members 218. However, it will be recognised that the centraliser 210 may have any suitable number of strut members 218. The strut members 218 form blades of the centraliser 210.

Unlike the strut members 18,118, the strut members 218 have a consistent convex curvature from end to end and are not bifurcated.

The centraliser 210 further comprises a retaining arrangement, generally denoted 220, for holding the strut members 218. The retaining arrangement 220 comprises a retainer member 222 which extends circumferentially between and disposed through the strut members 218.

In the illustrated centraliser 210, the retainer member 222 takes the form of a band of steel. However, it will be understood that the retainer member 222 may take a variety of different forms and be constructed from a variety of materials.

Figure 28:
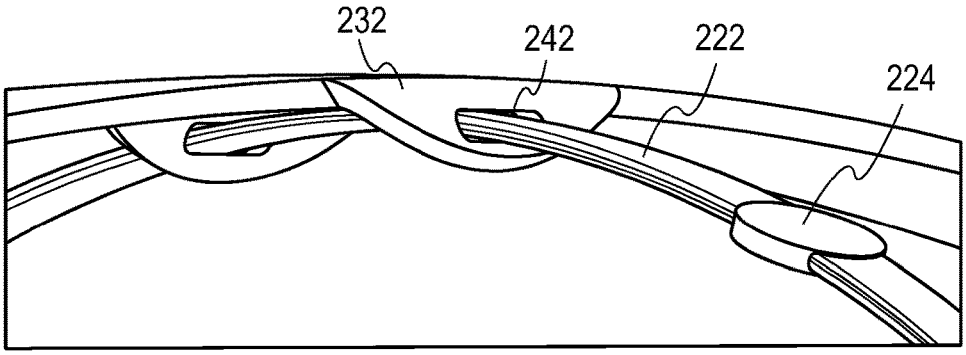
Figure 29:
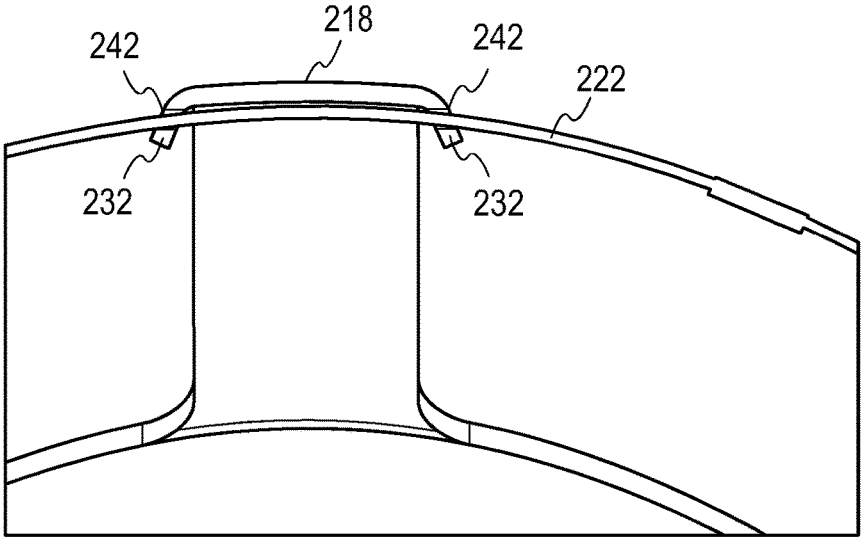

As shown most clearly in FIG. 28 of the accompanying drawings, the centraliser 210 further comprises a release arrangement 224. The release arrangement 224 is configured to release the retaining arrangement 220 and permit the strut members 218 to move between radially retracted and radially extended positions.

In use, the retaining arrangement 220 permits the strut members 218 to be held in compression until released by the release arrangement 224, at which point the strut members 218 can move between radially retracted and radially extended positions.

Beneficially, the retaining arrangement 220 prevents premature activation of the centraliser 210 while the release arrangement 224 provides an efficient and effective means to controllably release the retaining arrangement 220. Moreover, within a downhole system it is common for there to be moving parts which rotate and/or reciprocate within the annulus A. These may include, amongst other things, centralisers, rotating noses on float equipment, reamer shoes, perforating guns, liner hangers, packers, external casing and other completion equipment. Since the retainer member 222 is disposed through the strut members 218, the retainer member 222 is held in position after release; obviating the risk that the retainer member 222 will become an obstruction in the bore W. This is significant for a number of reasons. For example, having any obstructions, commonly known as 'junk', loose within the annulus A can cause failure due to tangling or bunching up of the loose parts around these moving parts. The annulus A is also commonly used to circulate fluids, such as drilling mud and/or cement, which may be critical to the safe and/or efficient operation of the bore W. Obstruction of the annulus A may require workover and in extreme cases abandonment of the bore W, at significant cost to an operator. Loose material is also known to have caused blockage to surface shaker equipment and other surface equipment.

Figure 27:
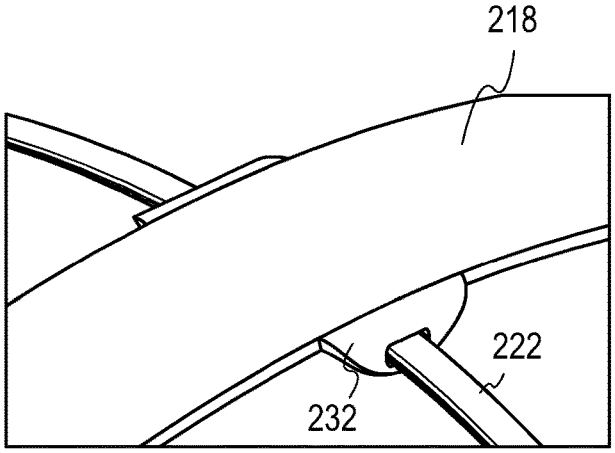
FIGS. 27, 28 and 29 show enlarged views of parts of the centraliser shown in FIG. 23.

As shown for example in FIG. 27 of the accompanying drawings, each of the strut members 218 has wing portions 232. The wing portions 232 are angled relative to the rest of the strut portion 218. In the illustrated centraliser 210, the wing portions 232 define an angle of approximately 90 degrees to the rest of the strut portion 218. However, the wing portions 232 may define other angles.

Figure 30:
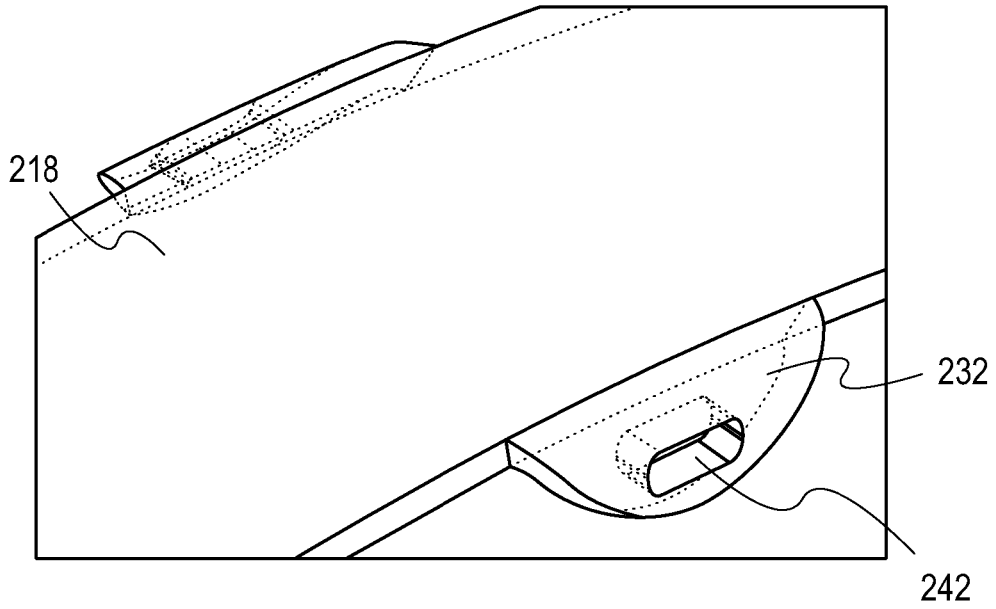
FIGS. 30 and 31 show enlarged view of parts of the centraliser shown in FIG. 14, with retainer member removed.
Figure 31:
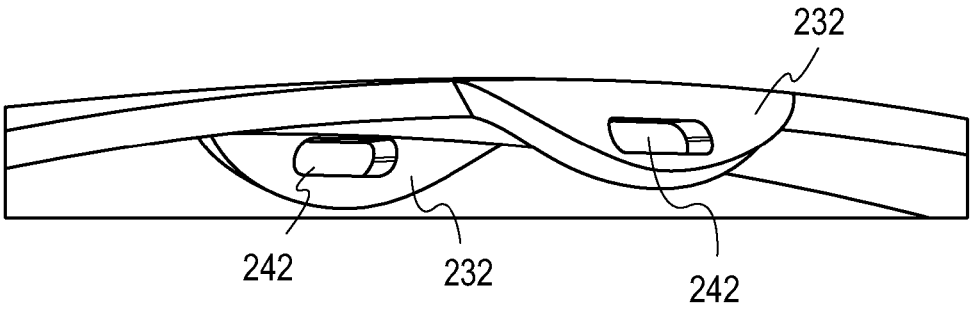

As shown most clearly in FIGS. 30 and 31, which show the centraliser 210 with the retainer member 222 removed, each of the wing portions 232 has an aperture 242 through which the retainer member 222 is disposed. In the illustrated centraliser 210, the apertures 242 take the form of elongate slots.

Providing the retainer member 222 through the wing portions 232 means that the retainer member 222 is disposed in a radially inwards position, having a diameter less than the drift diameter of the centraliser 210, and thus does not take up any space in the annulus A; either before or after release.

Moreover, providing the retainer member 222 through the wing portions 232 also means that the retainer member 222 is not only held radially but axially. The position of the retainer member 222 is thus further controlled both before and after release.

As noted above, it will be recognised that various modifications may be made without departing from the scope of the invention as defined in the claims.

Figure 32:
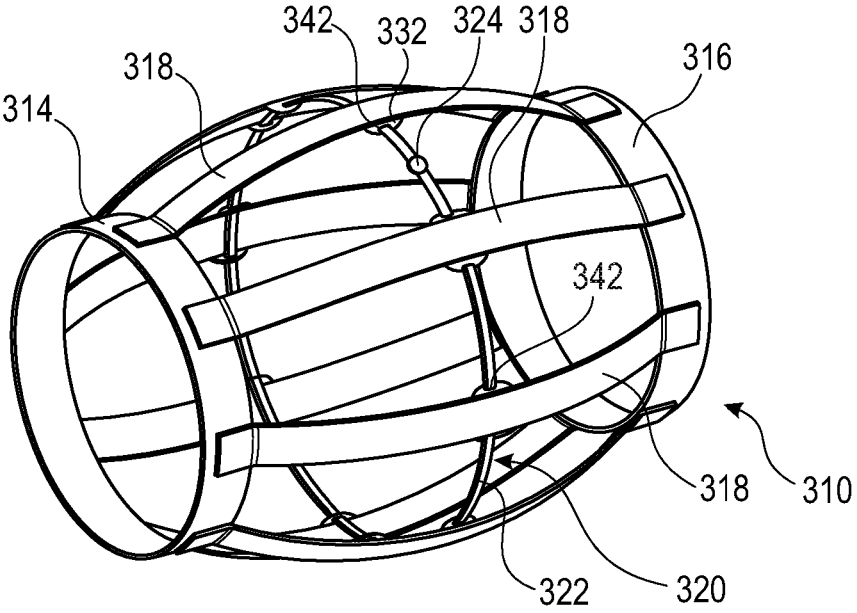
FIG. 32 shows an alternative centraliser for centralising tubing in a wellbore.

For example, FIG. 32 of the accompanying drawings shows an alternative centraliser 310. While the centralisers 10,110,210 described above are unitary in construction, the centraliser 310 is of non-unitary construction. As shown in FIG. 32, elongate strut members 318 are welded at respective ends to first end collar 314 and second end collar 316. Centraliser 310 further comprises a retaining arrangement, generally denoted 320, comprising retainer member 322 for holding the strut members 318 and a release arrangement 324 configured to release the retaining arrangement 320 and permit the strut members 318 to move between radially retracted and radially extended positions. The retaining arrangement 320 and 324 are identical to the retaining arrangement 20 and release arrangement 24 described above. In the illustrated centraliser 310, retainer member 322 takes the form of a band of steel. However, it will be understood that the retainer member 322 may take a variety of different forms and be constructed from a variety of materials.

Figure 33:
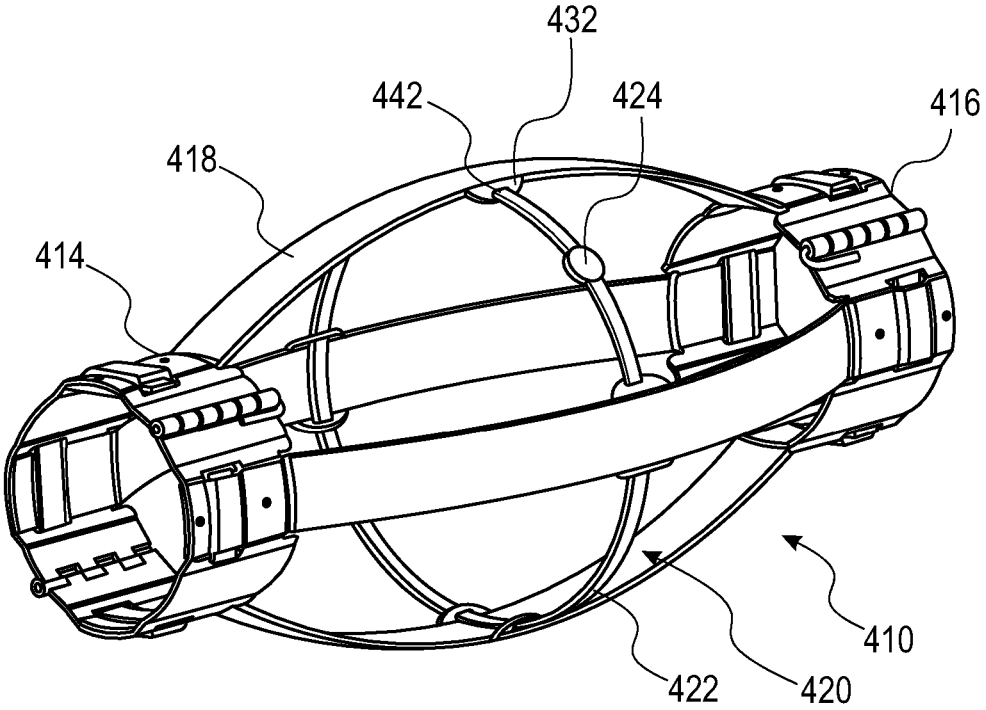
FIG. 33 shows an alternative centraliser for centralising tubing in a wellbore.

FIG. 33 of the accompanying drawings shows an alternative centraliser 410. As shown in FIG. 33, while the centralisers 10,110,210 described above are unitary in construction, the centraliser 410 is of non-unitary construction. As shown in FIG. 33, elongate strut members 418 are clamped at respective ends to first end collar 414 and second end collar 416. Centraliser 410 further comprises a retaining arrangement, generally denoted 420, comprising retainer member 422 for holding the strut members 418 and a release arrangement 424 configured to release the retaining arrangement 420 and permit the strut members 418 to move between radially retracted and radially extended positions. The retaining arrangement 420 and 424 are identical to the retaining arrangement 20 and release arrangement 24 described above. In the illustrated centraliser 410, retainer member 422 takes the form of a band of steel. However, it will be understood that the retainer member 422 may take a variety of different forms and be constructed from a variety of materials.

As described above, the centralisers 10,110,210,310,410 each comprise apertures 42,142,242,342,442 for receiving the retainer members 22,122,222,322,422. In the centralisers 10,110,210,310,410, the apertures 42,142,242,342,442 define a closed shape formed in the wing portions 32,132, 232,332,432. However, the apertures may take other forms.

Figure 34:
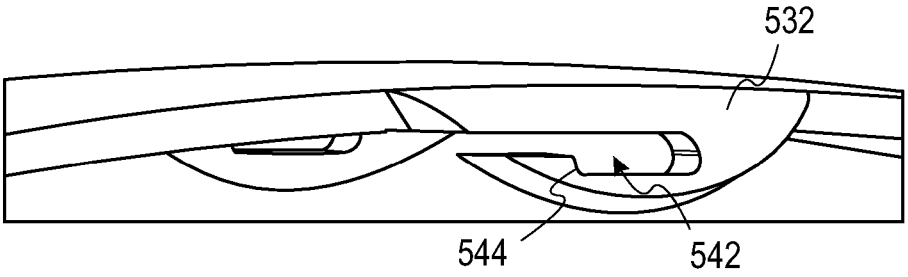
FIGS. 34, 35 and 36 show alternative forms of aperture.

For example, FIG. 34 of the accompanying drawings shows an aperture 542 that forms a slot in wing portion 532. The aperture 542 has a lip 544 that retains the retainer member (not shown).

Figure 35:
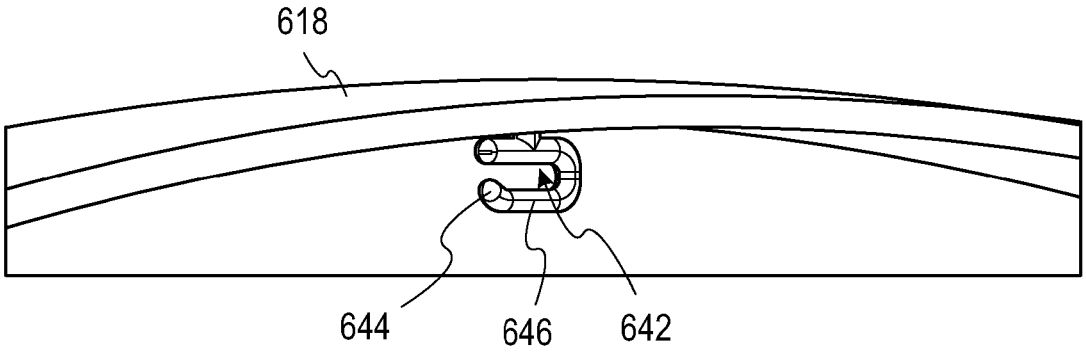

FIG. 35 of the accompanying drawings shows an alternative aperture 642. As shown in FIG. 35, the aperture 642 forms a slot and has a lip 644 that retains the retainer member (not shown). The aperture 642 is formed in a hook 646 that extends from an underside of intermediate member 618.

Figure 36:
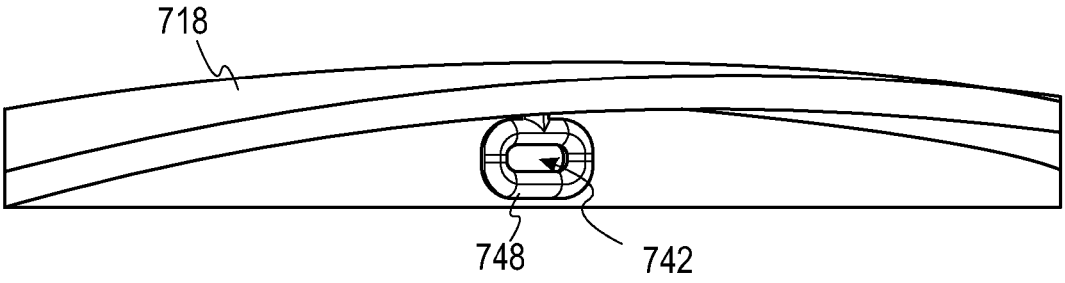

FIG. 36 of the accompanying drawings shows an alternative aperture 742. As shown in FIG. 35, the aperture 742 is formed in an eyelet 748 that extends from an underside of intermediate member 718.

As described above, the centralisers 10,110,210,210,410 each comprise a release arrangement 24,124,224,324,424. The release arrangement 24,124,224,324,424 may take a variety of different forms.

Figure 37:
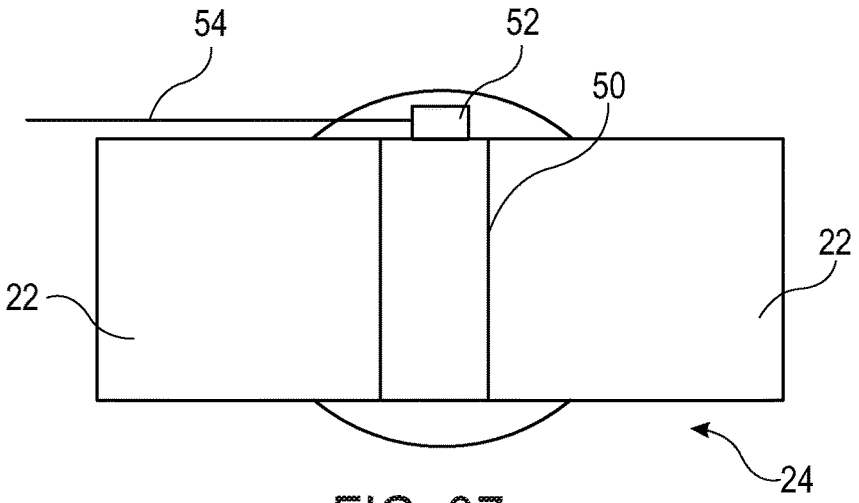
FIGS. 37 to 41 show a variety of release arrangements.

FIG. 37 of the accompanying drawings shows the release arrangement 24, in the form of a mechanical release arrangement. As shown in FIG. 37, the release arrangement 24 comprises a clasp 50 for holding the ends of the retainer member 22. The clasp 50 is retained by a latch 52 which is operable via a control line 54.

Figure 38:
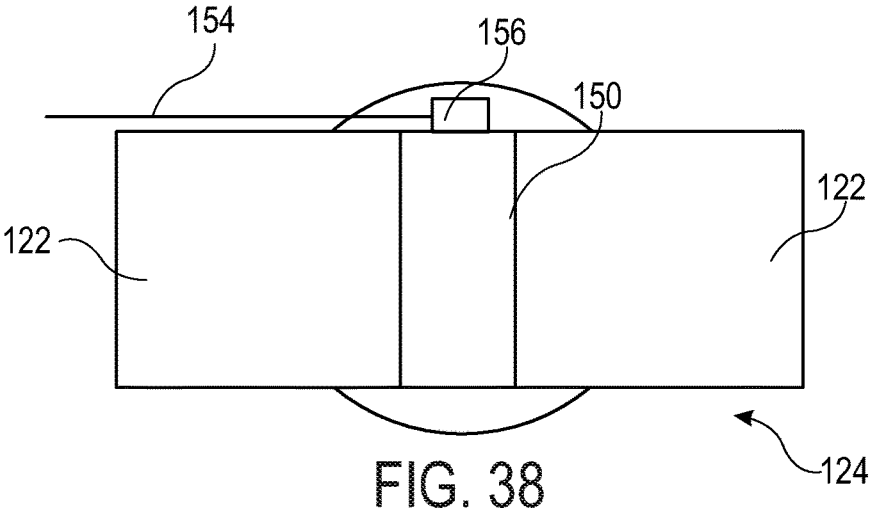

FIG. 38 of the accompanying drawings shows the release arrangement 124, in the form of a magnetic, in particular electro-magnetic, release arrangement. As shown in FIG. 38, the release arrangement 124 comprises a clasp 150 for holding the ends of the retainer member 122. The clasp 150 is retained by an electro-magnet 156 operable by cable 154.

Figure 39:
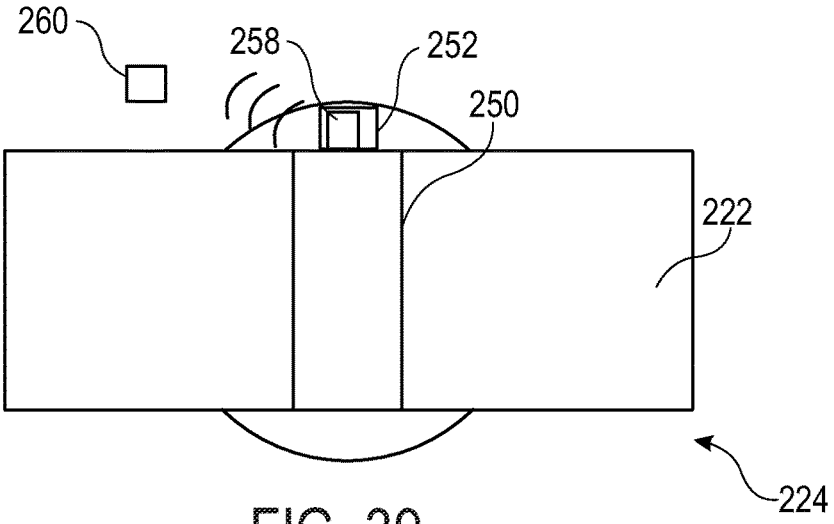

FIG. 39 of the accompanying drawings shows the release arrangement 224, in the form of an electrical release arrangement. As shown in FIG. 39, the release arrangement 224 comprises a clasp 250 for holding the ends of the retainer member 222. The clasp 250 is retained by a latch 252. In order to operate the latch 252, an antenna 258 communicates with a tag 260 such as RFID tag dropped or pumped down the annulus.

Figure 40:
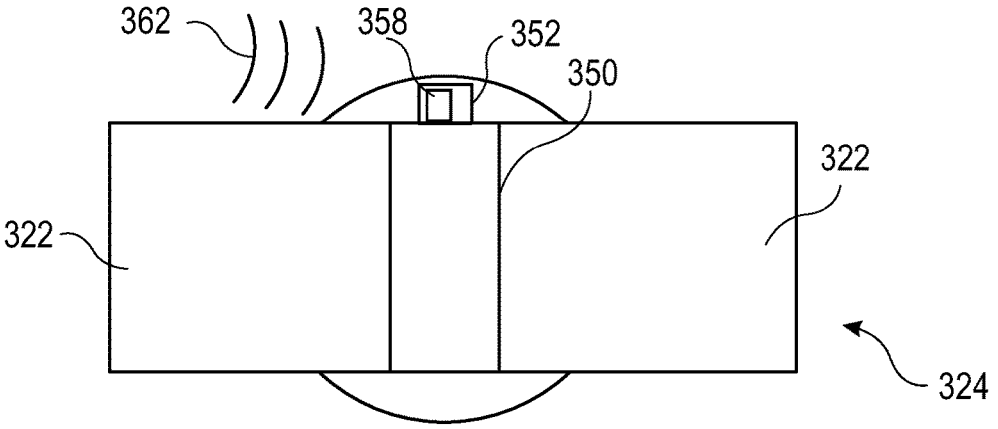

FIG. 40 of the accompanying drawings shows the release arrangement 324, in the form of a pressure and/or acoustic pulse release arrangement. As shown in FIG. 40, the release arrangement 324 comprises a clasp 350 for holding the ends of the retainer member 322. The clasp 350 is retained by a latch 352. In order to operate the latch 352, an antenna 358 receives a pressure and/or acoustic pulse signal 362 transmitted from surface or other uphole location.

Figure 41:
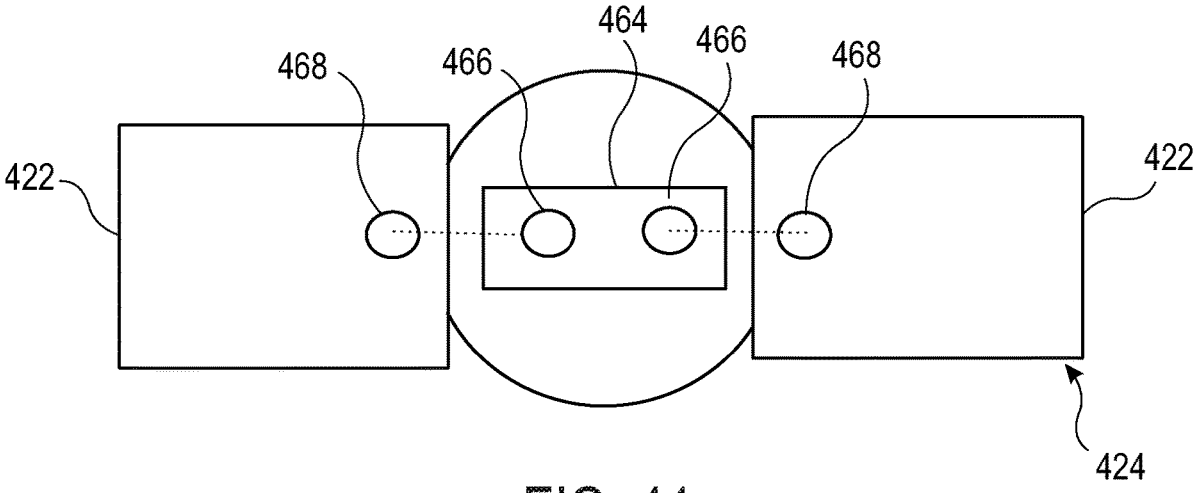

FIG. 41 of the accompanying drawings shows an exploded view of release arrangement 424, in the form of a chemical release arrangement. As shown in FIG. 41, the release arrangement 424 comprises a member 464 comprising bosses or tabs 466. The ends of the retainer member 422 are provided with bores 468 which seat on the bosses or tabs 466. The member 464 is constructed, e.g. 3-D printed, from a dissolvable metal. After running the centraliser 410 to the desired position, the drilling fluid would be displaced with fresh water or has a dissolving agent added so that the member dissolves after a selected time, thereby releasing the retainer member 422.

It will be understood that any of the release arrangements 24, 124,224,324,424 may be used in the centraliser configurations described herein.

Figure 42:
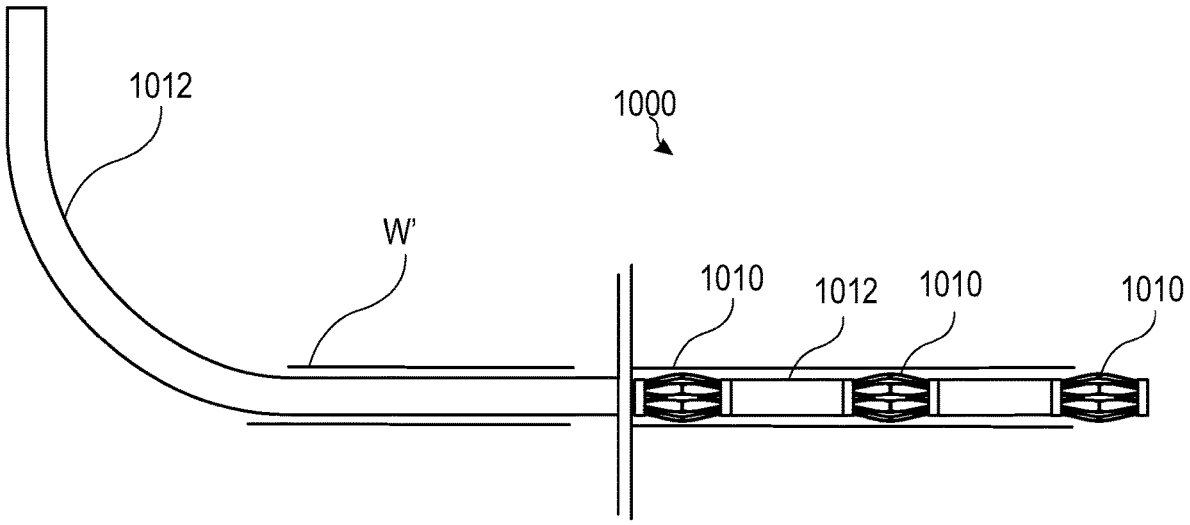
FIG. 42 shows a diagrammatic view of a downhole assembly.

Referring now to FIG. 42 of the accompanying drawings, there is shown a downhole assembly 1000 comprising a plurality of centralisers 1010. In the illustrated assembly 1000, the centralisers 1010 are identical to the centraliser 10 shown in FIG. 1. However, it will be understood that one or more of the centralisers 1010 may be identical to any of the centralisers described above.

As shown in FIG. 42, the centralisers 1010 are disposed on tubing 1012 which takes the form of a bore-lining tubing string, and more particularly a casing string, the tubing 1012 configured to be run into a bore W' in the form of a wellbore. In use, the centralisers 1010 centralise the tubing 1012 in the bore W' as described above.

Figure 43:
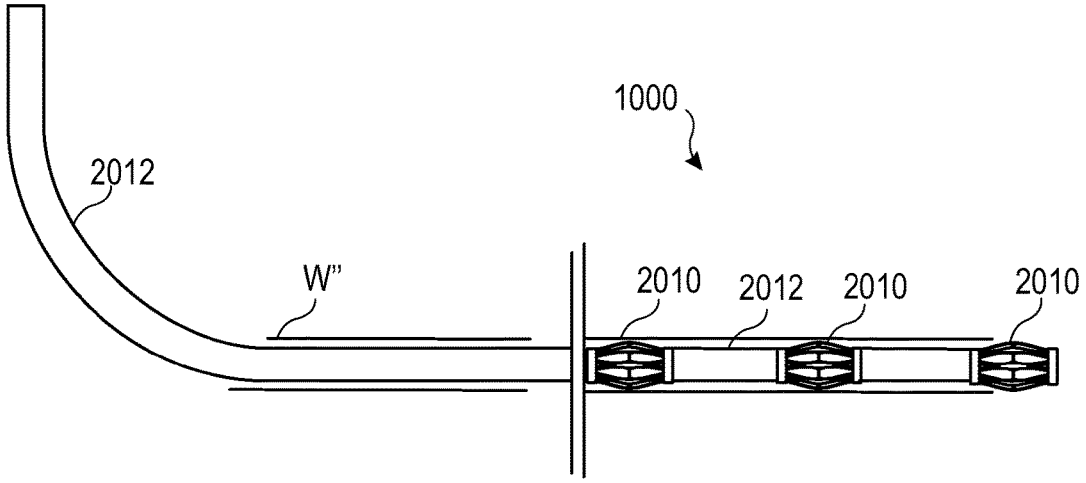
FIG. 43 shows a diagrammatic view of an alternative downhole assembly.

An alternative downhole assembly 2000 is shown in FIG. 43 of the accompanying drawings. In the illustrated assembly 2000, the centralisers 2010 are identical to the centraliser 10 shown in FIG. 1. However, it will be understood that one or more of the centralisers 2010 may be identical to the centraliser 110 or centraliser 210 described above.

As shown in FIG. 43, the centralisers 2010 are disposed on tubing 2012 which takes the form of a tubing string, and more particularly a work string, the tubing 2012 configured to be run into a bore W' in the form of a cased bore. In use, the centralisers 2010 centralise the tubing 2012 in the bore W" as described above.

The invention claimed is:

1. A centraliser for use in centralising tubing in a bore, comprising:
- a first end collar;
- a second end collar;
- a plurality of strut members interposed between the first end collar and the second end collar, wherein each strut member comprises a first end portion, a second end portion, and an intermediate portion interposed between the first end portion and the second end portion;
- a retaining arrangement for holding the strut members in a radially retracted position, wherein:
  - the retaining arrangement comprises a retainer member extending circumferentially between and disposed through the strut members; and
  - at least one of the strut members comprises an aperture for receiving the retainer member therethrough, wherein the aperture is provided in:
    - one or more wing portions of at least one of the strut members, the one or more wing portions extending inwards from the intermediate portion;
    - an eyelet that extends from an underside of at least one of the strut members; or
    - a hook that extends from an underside of at least one of the strut members; and
- a release arrangement configured to release the retaining arrangement and permit the strut members to move between the radially retracted position and a radially extended position.

2. The centraliser of claim 1, wherein the aperture is circular or substantially circular or takes the form of an elongate slot.

3. The centraliser of claim 1, wherein the retainer member comprises or takes the form of: a strap; a band; a wire; or a rope.

4. The centraliser of claim 1, wherein at least one of:
- the retainer member comprises a metallic material;
- the retainer member comprises a composite material;
- the retainer member comprises an aramid material; and/or
- the retainer member comprises a polyethylene material.

5. The centraliser of claim 4, wherein at least one of:
- the retainer member comprises steel;
- the retainer member comprises a carbon fibre composite;
- the retainer member comprises a para-aramid material; and/or
- the retainer member comprises an ultra-high molecular weight polyethylene material.

6. The centraliser of claim 1, wherein the release arrangement comprises or takes the form of:
- a mechanical release arrangement;
- an electrical release arrangement;

a magnetic release arrangement;

a pressure and/or an acoustic pulse release arrangement; and/or a chemical release arrangement configured to dissolve the retainer member.

7. The centraliser of claim 1, wherein the first end collar, the second end collar, and the strut members of the centraliser comprises a unitary construction.

8. The centraliser of claim 1, wherein the intermediate portion has a greater stiffness than the first end portion and the second end portion.

9. The centraliser of claim 1, wherein at least one of:

the centraliser is configurable in a first, larger diameter, configuration in which the intermediate portion assumes a radially extended position and in a second, smaller diameter, configuration in which the intermediate portion assumes a radially retracted position; and the first and second end portions of the strut members are configured to permit reconfiguration between the first, larger diameter, configuration and the second, smaller diameter, configuration.

10. The centraliser of claim 1, wherein:

the centraliser is reconfigurable from a first, larger diameter, configuration to a second, smaller diameter, configuration; and/or the centraliser is reconfigurable from the second, smaller diameter, configuration to the first, larger diameter, configuration.

11. The centraliser of claim 1, wherein at least one of the strut members comprises the one or more wing portions, and wherein the wing portions are integrally formed with the intermediate portion.

12. The centraliser of claim 11, wherein the wing portions comprise a bent or folded portion of the intermediate portion.

13. The centraliser of claim 1, wherein at least one of the strut members comprises the one or more wing portions, and wherein at least part of each wing portion is curved in at least one of:

a circumferential direction; and/or an axial direction.

14. The centraliser of claim 1, wherein the strut members are bifurcated.

15. The centraliser of claim 1, wherein at least part of the intermediate portion is curved in at least one of:

a circumferential direction; and/or an axial direction.

16. The centraliser of claim 1, wherein the first end portion and the second end portion each comprise at least two connectors for connecting the respective end portion to the respective end collar, the connectors of each of the first end portion and the second end portion diverging from the intermediate portion so as to be spaced apart at the end collars.

17. The centraliser of claim 1, wherein:

the intermediate portion comprises a curved section, defined in a direction along the strut members, the intermediate portion defining a convex outer surface; and the first end portion and the second end portion each comprise a curved section, defined in the direction along the strut members, the first end portion and the second end portion each defining a concave outer surface.

18. The centraliser of claim 17, wherein the curved section of the intermediate portion defines a first radius of curvature and the curved sections of the first end portion and the second end portion each define a second radius of curvature, the second radius of curvature being greater than the first radius of curvature defined by the intermediate portion.

19. A method of centralising tubing in a bore using the centraliser of claim 1.

20. A downhole assembly comprising at least one centraliser according to claim 1.

* * * * *